US005512250A

United States Patent [19]

Betta et al.

[11] Patent Number: 5,512,250

[45] Date of Patent: Apr. 30, 1996

[54] CATALYST STRUCTURE EMPLOYING INTEGRAL HEAT EXCHANGE

[75] Inventors: Ralph A. D. Betta, Mountain View; Toru Shoji, Sunnyvale; David K. Yee, San Bruno; Scott A. Magno, Dublin, all of Calif.

[73] Assignees: Catalytica, Inc., Mountain View, Calif.; Tanaka Kikinzoku Kogyo K.K., Tokyo, Japan

[21] Appl. No.: 205,279

[22] Filed: Mar. 2, 1994

[51] Int. Cl.[6] ..... F01N 3/10; F23D 3/40

[52] U.S. Cl. ..... 422/173; 422/175; 422/177; 422/180; 422/198; 422/206; 422/211; 422/222; 431/7; 431/170; 431/328; 60/723; 165/166; 165/167; 502/439; 502/527

[58] Field of Search ..... 422/173, 180, 422/198, 200, 206, 222, 175, 177, 211; 502/439, 339, 527; 165/102, 133, 166, 167, 10; 431/7, 2, 5, 170, 328

[56] References Cited

U.S. PATENT DOCUMENTS

| | | | |
|---|---|---|---|
| 3,568,462 | 3/1971 | Hoffman et al. | 165/166 X |
| 3,969,082 | 7/1976 | Cairns et al. | 422/180 |
| 4,279,782 | 7/1981 | Chapman et al. | 502/439 |
| 4,303,123 | 12/1981 | Skoog | 165/166 |
| 4,318,894 | 3/1982 | Hensel et al. | 422/177 |
| 4,331,631 | 5/1982 | Chapman et al. | 422/180 |
| 4,414,023 | 11/1983 | Aggen et al. | 502/439 |
| 4,492,268 | 1/1985 | Vehara et al. | 165/166 |
| 4,870,824 | 10/1989 | Young et al. | 60/723 |
| 4,936,380 | 6/1990 | Niggemann | 165/167 |
| 5,183,401 | 2/1993 | Betta et al. | 431/7 |
| 5,232,357 | 8/1993 | Betta et al. | 431/7 |
| 5,248,251 | 9/1993 | Betta et al. | 431/7 |
| 5,250,489 | 10/1993 | Betta et al. | 502/262 |
| 5,259,754 | 11/1993 | Betta et al. | 431/7 |

FOREIGN PATENT DOCUMENTS

| | | |
|---|---|---|
| 59-136140 | 11/1984 | Japan . |
| 61-259013 | 11/1986 | Japan . |

OTHER PUBLICATIONS

Whitaker, *Fundamental Principles of Heat Transfer*, Krieger Publishing Company, p. 296 (1983).

*Primary Examiner*—Robert J. Warden
*Assistant Examiner*—Hien Tran
*Attorney, Agent, or Firm*—Al A. Jecminek

[57] ABSTRACT

This invention is an improved catalyst structure and its use in highly exothermic processes like catalytic combustion. This improved catalyst structure employs integral heat exchange in an array of longitudinally disposed, adjacent reaction passage-ways or channels, which are either catalyst-coated or catalyst-free, wherein the configuration of the catalyst-coated channels differs from the non-catalyst channels such that, when applied in exothermic reaction processes, such as catalytic combustion, the desired reaction is promoted in the catalytic channels and substantially limited in the non-catalyst channels.

74 Claims, 9 Drawing Sheets

CATALYST STRUCTURE EMPLOYING INTEGRAL HEAT EXCHANGE

FIELD OF THE INVENTION

This invention relates to a catalyst structure employing integral heat exchange in an array of longitudinally disposed, adjacent reaction passageways or channels which are either catalyst-coated or catalyst-free, as well as a method for using the catalyst structure in highly exothermic processes, such as combustion or partial combustion processes. More particularly, this invention is directed to such a catalyst structure employing integral heat exchange wherein the catalytic and non-catalytic channels differ from each other in certain critical respects whereby the exothermic reaction in the catalytic channels and heat exchange between the catalytic and non-catalytic channels are optimized while undesired exothermic reaction in the non-catalytic channels is suppressed.

BACKGROUND OF THE INVENTION

In modern industrial practice, a variety of highly exothermic reactions are known to be promoted by contacting of the reaction mixture in the gaseous or vapor phase with a heterogeneous catalyst. In some cases these exothermic reactions are carried out in catalyst-containing structures or vessels where external cooling must be supplied, in part, because of the inability to obtain sufficient heat transfer and the need to control the reaction within certain temperature constraints. In these cases, it is not considered practical to use a monolithic catalyst structure, where the unreacted portion of the reaction mixture supplies the cooling for the catalytic reaction, because existing catalyst structures do not provide an environment whereby the desired reaction can be optimized while removing the heat of reaction through heat exchange with unreacted reaction mixture under conditions where undesired reactions and catalyst overheating are avoided. Thus, the applicability of monolithic catalysts structures to many catalyzed exothermic reactions could clearly be enhanced if monolithic catalyst structures could be developed wherein the reaction zone environment and heat exchange between reacted and unreacted portions of the reaction mixture are improved.

There is also a clear need to improve the operability of monolithic catalyst structures in areas where they are currently used or proposed for use, such as the combustion or partial combustion of fuels or the catalytic treatment of exhaust emissions from internal combustion engines, to widen the range of operating, conditions at which the desired catalytic conversions can be achieved. For example, in the case of catalytic combustion when applied to reduce $NO_x$ emissions from a gas turbine by equipping the turbine with a catalytic combustor, a clear need exists for catalytic systems or structures which will adapt to a variety of operational situations. A gas turbine used as a power source to drive a load must be operated over a range of speeds and loads to adjust power output to the load requirements. This means that the combustor must operate over a range of air and fuel flows. If the combustor system uses a catalyst to combust the fuel and limit emissions, then this catalyst system must be able to operate over a wide range of air flows, fuel/air ratios (F/A) and pressures.

Specifically in the case of an electric power generation turbine where the rotational speed is constant because of the need to generate power at a constant frequency, the air flow over the load range of 0% to 100% will be approximately constant. However, the fuel flow will vary to match the load required so the F/A will vary. In addition, the pressure will increase somewhat as the power output is increased. This means that the catalytic combustor must operate over a wide range of F/A and a range of pressures but at relatively constant mass flow. Alternatively, a variable portion of the air flow can be bypassed around the combustor or bled from the gas turbine to decrease the air flow and maintain a more constant F/A. This will result in a narrower range of F/A over the catalyst but a wider range of mass flows.

Further, in the case of a variable speed turbine, or a multiple shaft turbine, the air flow and pressure can vary widely over the operating range. This results in a wide variation of total mass flow and pressure in the combustor. Similar to the situation described above for the electric power generation turbine, the air can be bypassed or bled to control the F/A range resulting in a combustor that must operate over a range of mass flows.

The situations described above result in the need for a catalyst design that can operate over a wide mass flow range, pressure range and F/A range.

One particular application that could benefit from catalytic combustion is a gas turbine applied to a vehicle to achieve very low emissions. Once started, this engine must operate from idle to full load and achieve low emissions over this entire range. Even if the gas turbine is used in a hybrid vehicle design combined with a storage component such as a battery, flywheel, etc., the engine must still operate at idle and full load and must transit between these two operating points. This requires operation at mass flows and pressures of both of these conditions.

The present invention employs a catalyst structure made up of a series of adjacently disposed catalyst-coated and catalyst-free channels for passage of a flowing reaction mixture, wherein the catalytic and non-catalytic channels share a common wall such that integral heat exchange can be used to dissipate the reaction heat generated on the catalyst and thereby control or limit the temperature of the catalyst. That is, the heat produced on the catalyst in any given catalyst-coated channel flows through the common wall to the opposite non-catalytic surface to be dissipated into the flowing reaction mixture in the adjacent catalyst-free channel. With the present invention, the configuration of the catalytic channels differs from the non-catalytic channels in one or more critical respects, including the tortuosity of the flow channel, such that, when applied to catalytic combustion, catalytic and homogeneous combustion is promoted within the catalytic channels and not promoted or substantially limited in the non-catalytic channels while heat exchange is otherwise optimized. These uniquely configured catalyst structures substantially widen the window of operating parameters for catalytic combustion and/or partial combustion processes.

The use of catalyst supports having integral heat exchange in catalyst-promoted combustion or partial combustion is known in the art. In particular, Japanese Kokai 59-136,140 (published Aug. 4, 1984) and Kokai 61-259,013 (published Nov. 17, 1986) disclose the use of integral heat exchange in either a square-sectioned ceramic monolithic catalyst support in which alternating longitudinal channels (or layers) have catalysts deposited therein, or a support structure made up of concentric cylinders in which alternating annular spaces in the support are coated with catalyst. In both cases, the design of the catalyst structure disclosed is such that the configuration of the catalyst-coated channels and catalyst-free channels is the same with the catalytic and non-catalytic flow channels in each case being essentially straight and of the same cross-sectional area throughout their lengths.

A disclosure very similar to the two Japanese Kokai is seen in U.S. Pat. No. 4,870,824 to Young et al. where integral heat exchange is employed is a honeycomb support structure in which the catalyst-coated and catalyst-free channels are of identical configuration, being essentially straight and of unvarying square cross-sectional area throughout their length.

More recently, a series of U.S. patents have issued to Dalla Betta et al., including U.S. Pat. Nos. 5,183,401; 5,232,357; 5,248,251; 5,250,489 and 5,259,754, which describe the use of integral heat exchange in a variety of combustion or partial combustion processes or systems, including those where partial combustion of the fuel occurs in a integral heat exchange structure followed by subsequent complete combustion after the catalyst. Of these U.S. patents, U.S. Pat. No. 5,250,489 seems most in point, being directed to a metallic catalyst support made up of a high temperature resistant metal formed into a multitude of longitudinal passageways for passage of a combustible gas, with integral heat exchange being employed between passageways at least partially coated with catalyst and catalyst-free passageways to remove heat from the catalytic surface in the catalyst-coated passageways. The catalytic support structures disclosed in U.S. Pat. No. 5,250,489, include structures (FIGS. 6A and 6B) of U.S. Pat. No. 5,250,489 wherein the combustible gas passageways or channels are formed by alternating broad or narrow corrugations of a corrugated metal foil such that the size of the alternating catalytic and non-catalytic channels are varied to allow 80% of the gas flow to pass through the catalytic channels and 20% through the non-catalytic channels in one case (FIG. 6A), or 20% of the gas flow to pass through the catalytic channels and 80% through the non-catalytic channels in the other case (FIG. 6B). Using different sized channels as a design criterion, this patent teaches that any level of combustible gas conversion to combustion products between 5% and 95% can be achieved while incorporating integral heat exchange. While this patent does disclose the use of different sized catalytic and non-catalytic channels to vary the level of conversion, it clearly does not contemplate the use of channels having different tortuosity in the catalytic versus non-catalytic channels to optimize the combustion reaction in catalytic channels while substantially limiting homogeneous combustion in the non-catalytic channels as a means of widening the range of process conditions under which the catalyst structure can effectively operate.

In cases where the integral heat exchange structure is used to carry out catalytic partial combustion of a fuel followed by complete combustion after the catalyst, the catalyst must burn a portion of the fuel and produce an outlet gas sufficiently hot to induce homogeneous combustion after the catalyst. In addition, it is desirable that the catalyst not become too hot since this would shorten the life of the catalyst and limit the advantages to be gained from this approach. As the operating condition of the catalyst is changed, it is noted with the integral heat exchange structures of the prior art, discussed above, that operating window of such catalysts are limited. That is, that the gas velocity or mass flow rate must be within a certain range to prevent catalyst overheating.

Therefore, it is clear that a need exists for improved catalytic structures employing integral heat exchange which will substantially widen the window or range of operating conditions under which such catalytic structures can be employed in highly exothermic processes like catalytic combustion or partial combustion. The present invention capitalizes on certain critical differences in the configuration of the catalytic and non-catalytic passageways or channels in an integral heat exchange structure to materially widen the operating window for such catalysts.

SUMMARY OF THE INVENTION

In its broadest aspects, the present invention provides a novel catalyst structure comprised of a series of adjacently disposed catalyst-coated and catalyst-free channels for passage of a flowing reaction mixture wherein the channels at least partially coated with catalyst are in heat exchange relationship with adjacent catalyst-free channels and wherein the catalyst-coated channels have a configuration which forms a more tortuous flow passage for the reaction mixture than the flow passage formed by the catalyst-free channels. For convenience herein the terms "catalyst-coated channels" or "catalytic channels" in the catalyst structures of the invention may refer to single channels or groupings of adjacent channels which are all coated with catalyst on at least a portion of their surface, in effect a larger catalytic channel subdivided into a series of smaller channels by catalyst support walls or pervious or impervious barriers which may or may not be coated with catalyst. Similarly, the "catalyst-free channels" or "non-catalytic channels" may be a single channel or grouping of adjacent channels which are all not coated with catalyst, that is, a larger catalyst-free channel subdivided into a series of smaller channels by catalyst support walls or pervious or impervious barriers which are not coated with catalyst. In this regard, increased tortuosity of the flow passages formed by the catalyst-coated channels means that the catalyst-coated channels are designed such that at least a portion of the reaction mixture entering the catalyst-coated channels will undergo more changes in direction of flow as it traverses the length of the channel than will any similar portion of reaction mixture entering the catalyst-free channels. Ideally, if it were assumed that the longitudinal axes of the catalyst-coated channels is a straight line leading from the inlet of the channel to the outlet of the channel, increasing the tortuosity of the channel would result in a reaction mixture flow pathway which shows increasing directional deviations from the axis such that the path traveled by tracing the deviations becomes increasing longer than the path drawn by the axis.

In practice, the increased tortuosity of the flow passage in the catalyst-coated channels can be accomplished by a variety of structural modifications to the channels including periodically altering their direction and/or changing their cross-sectional area along their longitudinal axis while the catalyst-free channels remain substantially straight and unaltered in cross-sectional area. Preferably the tortuosity of the catalyst-coated channels is increased by varying their cross-sectional area though repeated inward and outward bending of channels walls along the longitudinal axis of the channels or through the insertion of flaps, baffles or other obstructions at a plurality of points along the longitudinal axes of the channels to partially obstruct and/or divert the direction of reaction mixture flow in the channels.

In a preferred aspect, the catalyst structure of the present invention can be further characterized by catalyst-coated channels that differ from the catalyst-free channels in one or more critical structural defining elements which, in turn, take advantage of, and expand upon, the concept of the increased tortuosity of the catalyst-coated channels. In particular, the preferred catalyst structure of the invention typically employs a plurality of longitudinally disposed channels coated on at least a portion of their interior surface with catalyst, that is, catalyst-coated channels, in heat exchange relationship with adjacent channels not coated with catalyst or catalyst-free channels wherein:

(a) the catalyst-coated channels have an average hydraulic diameter ($D_h$) which is lower than the average hydraulic diameter of the catalyst-free channels and/or;

(b) the catalyst-coated channels have a higher film heat transfer coefficient (h) than the catalyst-free channels.

The average hydraulic diameter or $D_h$, which is defined as four times the average cross-sectional area of all of the channels of a particular type, e.g., catalyst-coated channels, in the catalyst structure divided by the average wetted perimeter of all of the channels of that type in the catalyst structure, is reflective of the finding that the catalyst-free channels are most advantageously designed to have a larger hydraulic diameter and to be less effected by changes in configuration than the catalyst-coated channels. The film heat transfer coefficient or h is an experimentally determined value which correlates with, and expands upon the tortuosity of the average catalyst-coated channel versus that of the average catalyst-free channel in the catalyst structure.

Further optimization of the catalyst structure of the invention is obtained if, in addition to controlling the average $D_h$ and/or h as set forth above, the heat transfer surface area between the catalyst-coated channels and the catalyst-free channels is controlled such that the heat transfer surface area between the catalyst-coated channels and catalyst-free channels divided by the total channel volume in the catalyst structure is greater than about 0.5 $mm^{-1}$.

The catalyst structure of the invention is particularly useful when equipped with appropriate catalytic materials for use in a combustion or partial combustion process wherein a fuel, in gaseous or vaporous form, is typically partially combusted in the catalyst structure followed by complete homogeneous combustion downstream of the catalyst. With the catalyst structure according to the invention, it is possible to obtain more complete combustion of fuel in the catalytic channels with minimum combustion in the non-catalytic channels over a wider range of linear velocities, gas inlet temperatures and pressures than has here-to-for been possible with catalyst structures of the prior art, including those employing integral heat exchange. Accordingly, the invention also encompasses an improved catalyst structure for use in the combustion or partial combustion of a combustible fuel, as well as a process for combusting a mixture of a combustible fuel and air or oxygen-containing gas, using the catalyst structure of the invention.

DESCRIPTION OF THE INVENTION

Figure 1:
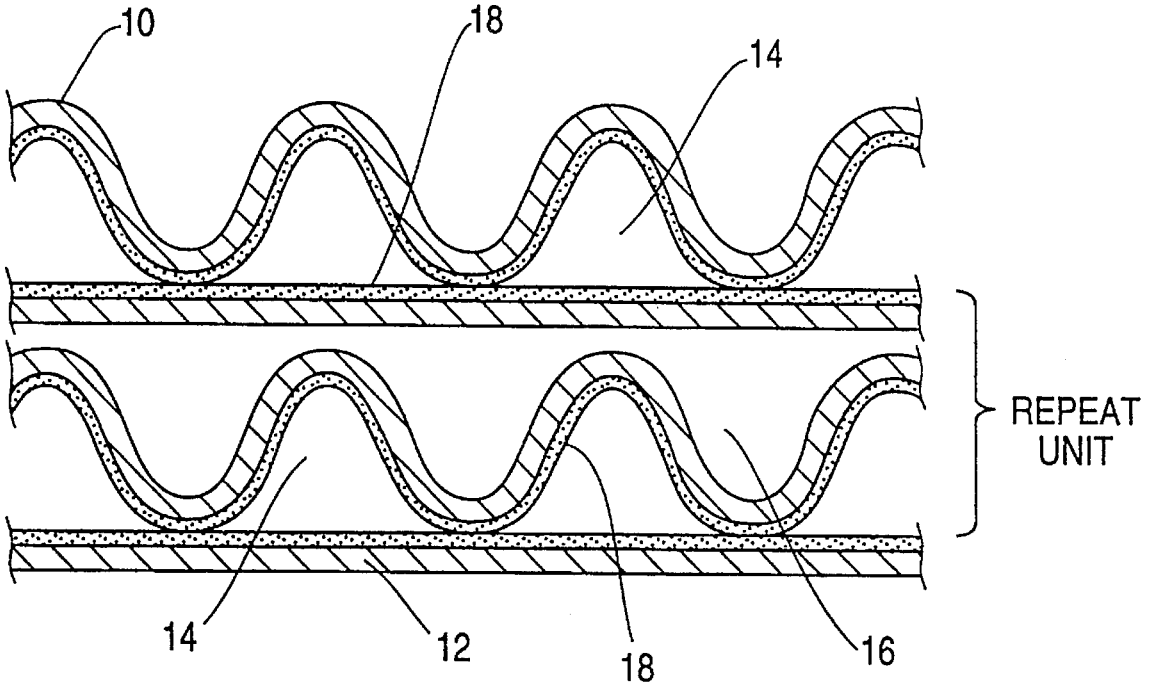
FIG. 1 (PRIOR ART)
FIGS. 1, 2, 3, 3A, 3B, and 3C schematically depict configurations of the prior art showing conventional forms of catalytic structures employing integral heat exchange.

When applied to the catalysis of highly exothermic reactions, the catalyst structures of the invention are typically monolithic-type structures comprising a heat resistant support material composed of a plurality of common walls which form a multitude of adjacently disposed longitudinal channels for passage of a gaseous reaction mixture wherein at least a portion of the channels are coated on at least a part of their interior surface with a catalyst for the reaction mixture (catalyst-coated channels) and the remaining channels are not coated with catalyst on their interior surface (catalyst-free channels) such that the interior surface of the catalyst-coated channels are in heat exchange relationship with the interior surface of adjacent catalyst-free channels and wherein the catalyst-coated channels differ in configuration from the catalyst-free channels such that the desired reaction is promoted in the catalytic channels and suppressed in the non-catalytic channels. In cases where the catalyst structure of the invention is employed in a catalytic combustion or partial combustion process, the critical difference in the design of the catalytic versus non-catalytic channels will insure more complete combustion of the fuel in the catalytic channels and minimum combustion in the non-catalytic channels over a wider range of linear velocity, inlet gas temperature and pressure.

The critical difference in the design of the catalytic versus non-catalytic channels for the catalytic structure of the invention, in its most basic terms, is that the catalytic channels are designed so that the reaction mixture flow passages defined by the catalytic channels possess a higher or increased tortuosity over the corresponding flow passages formed by the non-catalytic channels. The concept of tortuosity, as used herein, is defined as the difference between the length of the path which a given portion of reaction mixture will travel through the passage formed by the channel as a result of changes in direction of the channel and/or changes in channel cross-sectional area versus the length of the path traveled by a similar portion of the reaction mixture in a channel of the same overall length without changes in direction or cross-sectional area, in other words, a straight channel of unaltered cross-sectional area. The deviations from a straight or linear path, of course, result in a longer or more tortuous path and the greater the deviations from a linear path the longer the traveled path will be. When applied to the catalyst structures of the invention, differences in tortuosity between catalytic and non-catalytic channels is determined by comparing the average tortuosity of all of the catalytic channels in the structure to the average tortuosity of all of the non-catalytic channels in the structures.

In the catalyst structures of the invention a variety of structure modifications can be made to the channels coated with catalyst to increase their tortuosity relative to the non-catalytic channels. In particular, the tortuosity of the catalytic channels can be increased by periodically changing their direction, for example, by using channels having a zig-zag or wavy configuration or by repeatedly changing their cross-sectional area through periodic inward and outward bending of channel walls along their longitudinal axis or through the insertion of flaps, baffles or other obstructions to partially obstruct or divert the direction of reaction mixture flow at a plurality of points along the longitudinal axis of the channel. In some applications, it may be desirable to use a combination of changes in direction and changes in cross-sectional area to achieve an optimum difference in tortuosity but in all cases the tortuosity of the non-catalytic channel will be less on average than the tortuosity of the catalytic channels.

Preferably, the tortuosity of the catalytic channels is increased by changing their cross-sectional area at a multiplicity of points along their longitudinal axes. One preferred way of accomplishing this change in tortuosity for the catalytic channels, which is discussed in further detail below, involves the use of a stacked arrangement of non-nesting corrugated sheets of catalyst support material which are corrugated in a herringbone pattern with at least a portion of one side of a given corrugated sheet facing and stacked against another corrugated sheet being coated with catalyst such that the stacked sheets in question form a plurality of catalytic channels. By stacking the corrugated sheets together in a non-nesting fashion, the channels formed by the stacked sheets alternately expand and contract in cross-sectional area along their longitudinal axis due to the inwardly and outwardly bending peaks and valleys formed by the herringbone pattern of the corrugated sheets. Other preferred ways of changing the cross-sectional area of the catalyst-coated channels include the periodic placement of flaps or baffles on alternate sides of the channels along their longitudinal axis or the use of screens or other partial obstructions in the flow path formed by the catalytic channels. To avoid undue pressure drops across the channel the cross-sectional area of the channel should not be reduced by more than about 40% of its total cross-sectional area by any obstruction placed in the flow path formed by the channel.

As noted previously, in preferred catalyst structures of the invention the channels coated with catalyst differ from the catalyst-free channels by having an average hydraulic diameter ($D_h$) which is lower than the average hydraulic diameter of the catalyst-free channels and/or by having a higher film heat transfer coefficient (h) than the catalyst-free channels. More preferably, the catalyst-coated channels have both a lower $D_h$ and a higher h than the catalyst-free channels.

The average hydraulic diameter is defined in Whitaker, *Fundamental Principles of Heat Transfer*, Krieger Publishing Company (1983) at page 296 by the following formula:

$$D_h = 4\left[\frac{\text{cross-sectional area}}{\text{wetted perimeter}}\right]$$

Thus, for the catalyst structures of the invention, the average $D_h$ can be determined by first finding the $D_h$ for all of the catalyst-coated channels in the structure by calculating the average $D_h$ for any given channel over its entire length and then determining the average $D_h$ for the catalyst-coated channels by totalling up all of the calculated $D_h$s for the individual channels, multiplied by a weighing factor representing the fractional open frontal area for that channel. Following the same procedure, the average $D_h$ for the catalyst-free channels in the structure can also be determined.

As discussed above, the finding that the catalyst-coated channels most advantageously have a lower average $D_h$ than the catalyst-free channels can be explained, in part, by the fact that the catalyst-coated channels desirably have a surface to volume ratio which is higher than that of the catalyst-free channels, since hydraulic diameter bears an inverse relationship to surface to volume ratio. Further, in the catalyst structures of the invention, the difference in average $D_h$ of the catalyst-coated channels and catalyst-free channels gives an indication that the catalyst-free channels, on average, must be more open channeled and therefore, the gas flow through these channels is less effected by changes in the channel diameter than the catalyst-coated channels, again, in part, because of the higher surface to volume ratios in the catalyst-coated channels. Preferably, the numeric ratio of the average $D_h$ of the catalyst-coated channels to the average $D_h$ of the catalyst-free channels, that is, average $D_h$ of catalyst-coated channels divided by average $D_h$ of catalyst-free channels is between about 0.15 and about 0.9 and, most preferably, the ratio of average $D_h$ of catalyst-coated channels to catalyst-free channels is between about 0.3 and 0.8.

The film heat transfer coefficient (h) is a dimension-less value, which is measured experimentally by flowing gas, e.g., air or air/fuel mixtures, at a given inlet temperature through an appropriate test structure having the specified channel geometry and temperature and measuring the outlet gas temperature, with h being calculated using the experimentally determined values in the following equation which describes heat transfer for an incremental portion of the flow path $\Delta x$ (adapted from Whitaker, Ibid., equations 1.3-29 and 1.3-31 on pages 13 and 14):

$$FC_p\ (\Delta Tgas) = h\ A\ (Twall - Tgas)\ \Delta x$$

where

F is the gas flow rate;

$C_p$ is the heat capacity of the gas;

h is the heat transfer coefficient;

A is the wall area per unit channel length;

$\Delta$Tgas is the temperature rise in the gas stream over the incremental distance $\Delta x$;

Twall is the wall temperature at position x; and

T gas is the gas temperature at position x.

Integration of this equation from the inlet to the outlet of the test structure will allow determining the value of film heat transfer coefficient that gives a calculated outlet gas temperature that matches experiment.

Since the gas composition, flow rates, pressures and temperatures in the catalytic and non-catalytic channels of the catalyst structure of the invention are very similar, the film heat transfer coefficient provides useful means of characterizing the different flow geometries provided by the various flow channel configurations which distinguish the catalyst-coated channels from the catalyst-free channels of the catalyst structure according to the invention.

Since these different flow geometries, in turn, are related to the tortuosity of the flow path formed by the channels, the film heat transfer coefficient provides some measure of tortuosity as it is employed in the catalyst structures of the invention. While one skilled in the art could conceive of a variety of methods to measure or otherwise determine h in the catalyst structures of the invention, one convenient method would involve constructing an experimental test structure, for example, a solid thick metal structure, with internal space machined to simulate the desired channel shape; and then to test it in environments where the wall temperature is essentially constant from inlet to outlet or varies from inlet to outlet and is measured at several points along the channel length in the structure. For monoliths such as the straight channel structure depicted in FIG. 1 (see discussion below), the test structure can be a single channel or a linear array of channels. For a herringbone corrugation monolith such as that shown in FIG. 2 (also discussed below), the test structure would be a section of the linear region containing channels of non-nesting herringbone configuration between two metal sheets sufficiently wide to minimize side effects.

The above-described technique can be applied to any of the structures described herein by constructing the required test structure. In cases where the catalyst structure is a combination of several different channel configurations, each of the channel configurations can be tested separately and the numeric ratio for h(cat)/h(non-cat) can be determined by summing up the h's for each channel type (multiplied by a weighing factor representing the fractional open frontal area) in the catalyst structure and then dividing the sum of the h's for the catalytic channels by the sum of the h's for the non-catalytic channels.

The h(cat)/h(non-cat) ratios which characterize the difference in the configuration of the catalyst-coated and catalyst-free channels in the catalyst structure of the invention are further defined by the principle that in cases where h(cat)/h(non-cat) is greater than 1, the numeric ratio of the average hydraulic diameter ($D_h$) for the catalyst-coated channels divided by the average $D_h$ for the catalyst-free channels is smaller than the numeric ratio of the open frontal area of the catalyst-coated channels divided by the open frontal area of the catalyst-free channels. As used herein, open frontal area refers to the cross-sectional area of channels of a given type, i.e., catalytic or non-catalytic, averaged over the catalyst structure in question; the cross-sectional area being the area open to reaction mixture flow in a channel, measured perpendicular to the reaction mixture flow direction. Introduction of this numeric ratio based on open frontal area is reflective of the fact that the catalyst-coated channels of the present invention have a sufficient increase in tortuosity over the catalyst-free channels to be clearly distinguishable from prior art structures employing integral heat exchange where the flow ratio through catalytic and non-catalytic channels is controlled by the use of different sized channels of the same basic configuration. That is, in cases where the reaction mixture flow is less than 50% through the catalytic channels in such prior art structures, the catalytic channels have a smaller average $D_h$ than the non-catalytic channels and the ratio of h(cat)/h(non-cat) can exceed 1. By introducing the concept that the numeric ratio of average $D_h$ for catalytic channels divided by average $D_h$ for non-catalytic channels must be smaller than the numeric ratio of open frontal area for catalytic channels divided by open frontal area of non-catalytic channels the catalyst structures of the present invention can be clearly differentiated from the prior art structures.

Alternatively, the catalyst structures of the present invention can be distinguished by the use of higher film heat transfer coefficients (h) for the catalytic channels verses non-catalytic channels than is characteristic of the prior art structures employing catalytic and non-catalytic channels which are of different size but the same basic configuration. In a prior art straight channel structure with catalytic channels that represent 20% of the open frontal area and non-catalytic channels representing 80% of the open frontal area, the heat transfer coefficient of the catalytic channels would be approximately 1.5 times the heat transfer coefficient of the non-catalytic channels. The structures of this invention would have heat transfer coefficients in the catalytic channels substantially larger than 1.5 times the heat transfer coefficient of the non-catalytic channels. More specifically, for catalyst structures having various reaction flow distributions between catalytic and non-catalytic channels, the following table defines catalyst structures of the invention.

| Percent of Total Reaction Mixture Flow through Catalytic Channels | Ratio of h(cat)/h(non-cat) |
|---|---|
| 50 and higher | >1.0 |
| Less than 50 but more than 40 | >1.2 |
| Less than 40 but more than 30 | >1.3 |
| Less than 30 but more than 20 | >1.5 |
| Less than 20 but more than 10 | >2.0 |

In any case, if the ratio of h(cat)/h(non-cat) is greater than 1, that is, h for the catalyst-coated channels is higher than h for the catalyst-free channels, then the catalyst structure is within the scope of the present invention. Preferably, catalyst structures of the invention have h(cat)/h(non-cat) ratios in the range of about 1.1 and about 7, and most preferably the ratio is between about 1.3 and about 4.

As noted previously, the performance of the catalyst structures of the invention can be further optimized if the catalyst-coated and catalyst-free channels are configured such that the heat transfer surface area between the catalyst-coated and the catalyst-free channels divided by the total channel volume in the catalyst structure is greater than about 0.5 $mm^{-1}$. In preferred catalyst structures of the invention, the ratio of heat transfer area between the catalyst-coated and the catalyst-free channels divided by the total channel volume in the catalyst structure or R is between about 0.5 $mm^{-1}$ and 2 $mm^{-1}$ with Rs in the range of about 0.5 $mm^{-1}$ to about 1.5 $mm^{-1}$ being most preferred. With these high heat transfer surface to total volume ratios or Rs, the transfer of heat from the catalyst to the non-catalytic side of the channel wall for dissipation into the flowing reaction mixture is optimized. With optimum removal of heat from the catalytic surface by this integral heat exchange, it is possible to operate the catalyst under more severe conditions without causing overheating of the catalyst. This is advantageous since it contributes to widening the range of conditions under which the catalyst can be operated.

The catalyst structures of the invention can be designed to operate over a wide reaction mixture flow distribution between the catalytic and non-catalytic channels. By controlling the size and number of catalytic versus non-catalytic channels in the catalyst structure between about 10% and about 90% of the total flow can be directed through the catalytic channels depending on the exothermic nature of the reaction being catalyzed and the extent of conversion desired. Preferably, in highly exothermic processes like combustion or partial combustion of a fuel, the ratio of reaction mixture flow through the catalyst structure is controlled so that between about 35% to about 70% of the flow is through the catalytic channels with most preferred catalyst structures having about 50% of the flow through the catalytic channels. In cases where the catalyst structures of the invention are characterized solely by the presence of catalytic channels having a smaller average $D_h$ than the non-catalytic channels, the reaction mixture flow distribution is controlled such that the open frontal area of the catalytic channels represents from about 20% to about 80% of the total open frontal area, while the catalytic and non-catalytic channels are configured such that the ratio of the average $D_h$ of the catalytic channels to the average $D_h$ of the non-catalytic channels is smaller than the ratio of open frontal area of the catalytic channels to the open frontal area of the non-catalytic channels. As used above, open frontal area refers to the cross-sectional area of channels of a given type, i.e., catalytic or non-catalytic averaged over the catalyst structure in question; the cross-sectional area being the area open to reaction mixture flow in a channel measured perpendicular to the reaction mixture flow.

For catalyst structures of the invention characterized solely by the presence of catalytic channels having a higher h than the non-catalytic channels, the ratio h(cat)/h(non-cat) is desirably greater than about 1.5 when the catalytic channels represent from about 20% to about 80% of the total open frontal area in the catalyst structure. Preferred catalytic structures of this type have h(cat)/h(non-cat) ratios in the range of about 1.5 to about 7.

In a preferred aspect, the present invention is directed to catalyst structures which are uniquely useful in the catalytic combustion or partial combustion of a fuel. These catalyst structures are typically monolithic in nature and comprise a heat resistant support material composed of a plurality of common walls which form a multitude of adjacently disposed longitudinal channels for passage of a combustible mixture, e.g., a fuel in gaseous or vaporous form mixed with an oxygen-containing gas such as air. The adjacently disposed channels are designed so that at least a portion of the channels are coated on at least a part of their interior surface with a catalyst suitable for oxidizing the combustible mixture, that is, catalyst-coated channels, and the remaining channels are not coated with catalyst on their interior surface, that is, catalyst-free channels, such that the interior surface of the catalyst-coated channels are in heat exchange relationship with the interior surface of adjacent catalyst-free channels. In this preferred aspect of the invention, the above-described catalyst structures are characterized by the presence of catalyst-coated channels or catalytic channels which differ in configuration from the catalyst-free channels or non-catalytic channels in one or more of the critical respects described above such that the desired combustion or oxidation reaction is promoted in the catalytic channels while it is substantially suppressed in the non-catalytic channels. This extra element of control of the reaction coupled with the enhanced heat transfer which is obtained allows the catalytic combustion process to be operated over a wider range of operating parameters, such as linear velocity, inlet gas temperature and pressure.

In this preferred aspect of the invention, the catalyst structure is suitably a platinum group metal-based catalyst on a ceramic or metal monolith. The monolithic support is assembled such that the catalytic and non-catalytic channels extend in a longitudinal direction from one end of the support to the other, thus enabling the combustible gas to flow from end to end through the length of the channels. The catalytic channels, which have catalyst coated on at least a portion of their interior surfaces, need not be coated along their entire length. Further, the channels not coated with catalyst or non-catalytic channels have no catalyst on their interior walls or an inactive or very low activity coating on their walls.

The support materials suitably employed in the catalyst structures may be any conventional heat resistant, inert material such as a ceramic, heat resistant inorganic oxides, intermetallic materials, carbides, nitrides or metallic materials. The preferred supports are high temperature resistant intermetallic or metallic materials. These materials are strong yet malleable, may be mounted and attached to surrounding structures more readily and offer more flow capacity, per unit of cross-sectional area, due to walls which are thinner than can be readily obtained in ceramic supports. Preferred intermetallic materials include metal aluminides, such as nickel aluminide and titanium aluminide, while suitable metallic support materials include aluminum, high temperature alloys, stainless steels, aluminum-containing steels and aluminum-containing alloys. The high temperature alloy may be a nickel or cobalt alloy or other alloy rated for the required temperature service. If heat resistant inorganic oxides are employed as the support material they are suitably selected from silica, alumina, magnesia, zirconia and mixtures of these materials.

The preferred materials are aluminum-containing steels such as those found in U.S. Pat. Nos. 4,414,023 to Aggen et al., 4,331,631 to Chapman et al., and 3,969,082 to Cairns et al. These steels, as well as others sold by Kawasaki Steel Corporation (River Lite 2-5-SR), Vereinigte Deutchse Metallwerke AG (Alumchrom I RE), and Allegheny Ludium Steel (Alfa-IV), contain sufficient dissolved aluminum so that, when oxidized, the aluminum forms alumina whiskers, crystals, or a layer on the steel's surface to provide a rough and chemically reactive surface for better adherence of the catalyst or of a washcoat for the catalyst.

For catalyst structures in this preferred aspect of the invention, the support material, preferably metallic or intermetallic, may be fabricated using conventional techniques to form a honeycomb structure, spiral rolls or stacked patterns of corrugated sheet, sometimes inter-layered with sheets which may be flat or of other configuration, or columnar or other configuration which allow for the presence of adjacent longitudinal channels which are designed to present flow channels in accordance with the design criteria set forth above. If intermetallic or metallic foil or corrugated sheet is employed, the catalyst will be applied to only one side of the sheet or foil or in some cases the foil or sheet will remain uncoated depending on the catalyst structure design chosen. Applying the catalyst to only one side of the foil or sheet, which is then fabricated into the catalyst structure, takes advantage of the integral heat exchange concept, allowing heat produced on the catalyst to flow through the structure wall into contact with the flowing gas at the opposite non-catalytic wall thereby facilitating heat removal from the catalyst and maintaining the catalyst temperature below the temperature for complete adiabatic reaction. In this regard, the adiabatic combustion temperature is the temperature of the gas mixture if the reaction mixture reacts completely and no heat is lost from the gas mixture.

In many cases for catalyst structures employed in combustion processes, it may be useful to apply a washcoat to the support wall before depositing the catalyst to improve the stability and performance of the catalyst. Suitably this washcoat may be applied using an approach such as is described in the art, e.g., the application of gamma-alumina, zirconia, silica, or titania materials (preferably sols) or mixed sols of at least two oxides containing aluminum, silicon, titanium, zirconium, and additives such as barium, cerium, lanthanum, chromium, or a variety of other components. For better adhesion of the washcoat, a primer layer can be applied containing hydrous oxides, such as a dilute suspension of pseudoboehmite alumina, as described in U.S. Pat. No. 4,279,782 to Chapman et al. The primed surface may be coated with a gamma-alumina suspension, dried, and calcined to form a high surface area adherent oxide layer on the metal surface. Most desirably, however, is the use of a zirconia sol or suspension as the washcoat. Other refractory oxides, such as silica and titania, are also suitable. Most preferred for some platinum group metals, notably palladium, is a mixed zirconia/silica sol where the two have been mixed prior to application to the support.

The washcoat may be applied in the same fashion one would apply paint to a surface, e.g., by spraying, direct application, dipping the support into the washcoat material, etc.

Aluminum structures are also suitable for use in this invention and may be treated or coated in essentially the same manner. Aluminum alloys are somewhat more ductile and likely to deform or even to melt in the temperature operating envelope of the process. Consequently, they are less desirable supports but may be used if the temperature criteria can be met.

For ferrous metals containing aluminum, the sheet may be heat treated in air to grow whiskers at the surface that increase adhesion of subsequent layers or provide increased surface area for direct application of a catalyst. A silica, alumina, zirconia, titania, or refractory metal oxide washcoat may then be applied by spraying onto the metal foil a solution suspension, or other mixture of one or more materials selected from alumina, silica, zirconia, titania and a refractory metal oxide, and drying and calcining to form a high surface area washcoat. The catalyst can then be applied, again such as by spraying, dripping or coating a solution, suspension, or mixture of the catalytic components onto the washcoats on the metal strip.

The catalytic material may also or alternatively be included in the washcoat material and coated onto the support thereby partially eliminating the separate catalyst inclusion step.

In the catalytic combustion application, where a substantial portion of the combustion is carried out after the gas exits the catalyst, the catalyst structure may be sized to achieve a gas temperature exiting the catalyst no more than 1000° C., preferably in the range of 700° C. and 950° C. The preferred temperature is dependent on the fuel, the pressure and on the specific combustor design. The catalyst can incorporate a non-catalytic diffusion barrier layer on the catalytic material such as that described in U.S. Pat. No. 5,232,357.

The catalytic metal content of the composite, i.e., the catalyst structure, is typically quite small, e.g., from 0.01% to about 15% by weight, and preferably from 0.01% to about 10% by weight. Although many oxidation catalysts are suitable in this application, Group VIII noble metals or platinum group metals (palladium, ruthenium, rhodium, platinum, osmium, and iridium) are preferred. More preferred are palladium (because of its ability to self-limit combustion temperatures) and platinum. The metals may be used singly or in mixtures. Mixtures of palladium and platinum, are desirable since they produce a catalyst having the temperature limiting capabilities of palladium, although at a different limiting temperature, and the mixture is less susceptible to deactivation by reaction with impurities in the fuel or by reaction with the catalyst support.

The platinum group metals or elements may be incorporated onto the support employed in the catalyst structure of the invention by a variety of different methods using noble metal complexes, compounds, or dispersions of the metal. The compounds or complexes may be water of hydrocarbon soluble. The metal may be precipitated from solution. The liquid carrier generally needs only to be removable from the catalyst carrier by volatilization or decomposition while leaving the metal in a dispersed form on the support.

Suitable platinum group metal compounds are, for example, chloroplatinic acid, potassium platinum chloride, ammonium platinum thiocyanate, platinum tetrammine hydroxide, platinum group metal chlorides, oxides, sulfides, and nitrates, platinum tetrammine chloride, platinum ammonium nitrite, palladium tetrammine chloride, palladium ammonium nitrite, rhodium chloride, and hexamine iridium chloride. If a mixture of metals is desired, they may be in water soluble form, for example, as amine hydroxides or they may be present in such forms as chloroplatinic acid and palladium nitrate when used in preparing the catalyst of the present invention. The platinum group metal may be present in the catalyst composition in elemental or combined forms, e.g., as an oxide or sulfide. During subsequent treatment such by calcining or upon use, essentially all of the platinum group metal is converted to the elemental form.

Additionally, by placing a more active catalyst, preferably palladium, on the portion of the catalyst structure which first contacts the combustible gas, the catalyst will "light off" more easily and yet not cause "hot spots" in the latter regions of the structure. The leading portion may be more active because of higher catalyst loadings, higher surface area, or the like.

In the catalytic combustion application, the catalyst structure of the invention should be made in such a size and configuration that the average linear velocity of the gas through the longitudinal channels in the catalyst structure is greater than about 0.02 m/second throughout the catalytic structure and no more than about 80 m/second. The lower limit is larger than the flame front speed for methane in air at 350° C. and the upper limit is a practical one for the type of supports currently commercially available. These average velocities may be somewhat different for fuels other than methane. Slower burning fuels may permit use of a lower minimum and maximum space velocity.

The average size of the channels employed in the catalyst structure can vary widely dependent on the nature of the reaction mixture. For catalytic combustion, suitable catalyst structures contain about 50 to about 600 channels per square inch. Preferably, the catalyst structure will contain from about 150 to about 450 channels per square inch.

The catalytic combustion process of the invention employing the catalyst structure of the invention may be used with a variety of fuels and at a broad range of process conditions.

Although normally gaseous hydrocarbons, e.g., methane, ethane, and propane, are highly desirable as a source of fuel for the process, most fuels capable of being vaporized at the process temperatures discussed below are suitable. For instance, the fuels may be liquid or gaseous at room temperature and pressure. Examples include the low molecular weight hydrocarbons mentioned above, as well as butane, pentane, hexene, heptene, octane, gasoline, aromatic hydrocarbons, such as benzene, toluene, ethylbenzene, xylene, naphthas, diesel fuel, kerosene, jet fuels, other middle distillates, heavy distillate fuels (preferably hydro-treated to remove nitrogenous and sulfurous compounds), oxygen-containing fuels, such as alcohols including methanol, ethanol, isopropanol, butanol, or the like; ethers, such as diethylether, ethyl phenyl ether, MTBE, etc. Low-BTU gases, such as town gas or syngas, may also be used as fuels.

The fuel is typically mixed into the combustion air in an amount to produce a mixture having a theoretical adiabatic combustion temperature or Tad greater than the catalyst or gas phase temperatures present in the catalysts employed in the process of the invention. Preferably the adiabatic combustion temperature is above 900° C., and most preferably above 1000° C. Non-gaseous fuels should be vaporized prior to their contacting the initial catalyst zone. The combustion air may be compressed to a pressure of 500 psig. or more. Stationary gas turbines often operate at pressures in the vicinity of 150 psig.

The process of the invention can be carried out in a single catalytic reaction zone employing the catalyst structure of the invention or in multiple catalytic reaction zones, usually 2 or 3, using catalyst structures designed specifically for each catalytic stage. In most cases the catalytic reaction zone will be followed by a homogeneous combustion zone in which the gas exiting from the earlier catalytic combustion zone is combusted under non-catalytic, non-flame conditions to afford the higher gas temperature, e.g., temperatures in the range of 1000°–1500° C., required by gas turbines.

The homogeneous combustion zone is sized to achieve substantially complete combustion and to reduce the carbon monoxide level to the desired concentration. The gas residence time in the post-catalyst reaction zone is 2 to 100 ms, preferably 10 to 50 ms.

Figure 2:
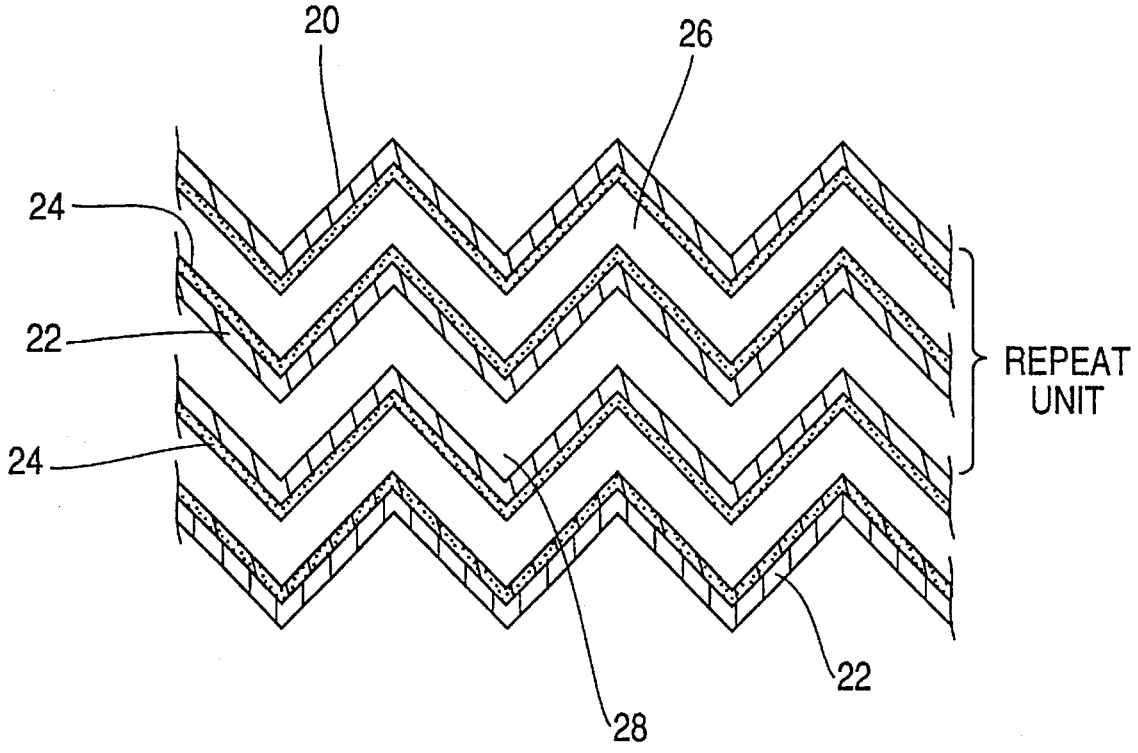
FIG. 2 (PRIOR ART)

Referring now to the drawings, FIGS. 1 and 2 depict end views of repeating units of two conventional catalyst structures employing integral heat exchange. The repeating units shown would appear in a stacked or layered pattern in the complete catalyst structure. In FIG. 1 the support is made up of two metallic sheets or strips one (10) having an undulating or wavy corrugation pattern and the other (12) being flat. The crests and valleys formed by the corrugation extend in a longitudinal direction over the width of the sheet and nest against the flat sheets both above and below the corrugated sheet to form straight longitudinal channels (14 and 16) which extend over the width of the stacked or nesting sheets. The undulating or sinusoidal corrugation pattern shown here is only representative. The corrugation can be sinusoidal, triangular, or any other conventional structure. The bottom side of the undulating sheet (10) and the top side of the flat sheet (12) are coated with catalyst or washcoat plus catalyst (18) such that when the sheets are stacked together as shown, channels coated with catalyst (14) are in integral heat exchange with channels not coated with catalyst (16). As noted above, the catalytic channels (14) and non-catalytic channels (16) formed are essentially straight and of unaltered cross-sectional area. This structure provides catalytic and non-catalytic channels wherein the ratio of the average $D_h$ of the catalytic channels to average $D_h$ of the non-catalytic channels is 1 and the h(cat)/h(non-cat) ratio is also 1.

The repeating unit shown in FIG. 2 is comprised of two corrugated metallic sheets (20 and 22) having a herringbone corrugation pattern extending in a longitudinal direction over the length of the sheets. One of the corrugated sheets (22) is coated with catalyst (24) on its top side while the other corrugated sheet is coated with catalyst on its bottom side such that when the sheets are stacked together in non-nesting fashion a catalyst-coated channel (26) is formed in integral heat exchange with a catalyst-free channel (28).

Figure 3:
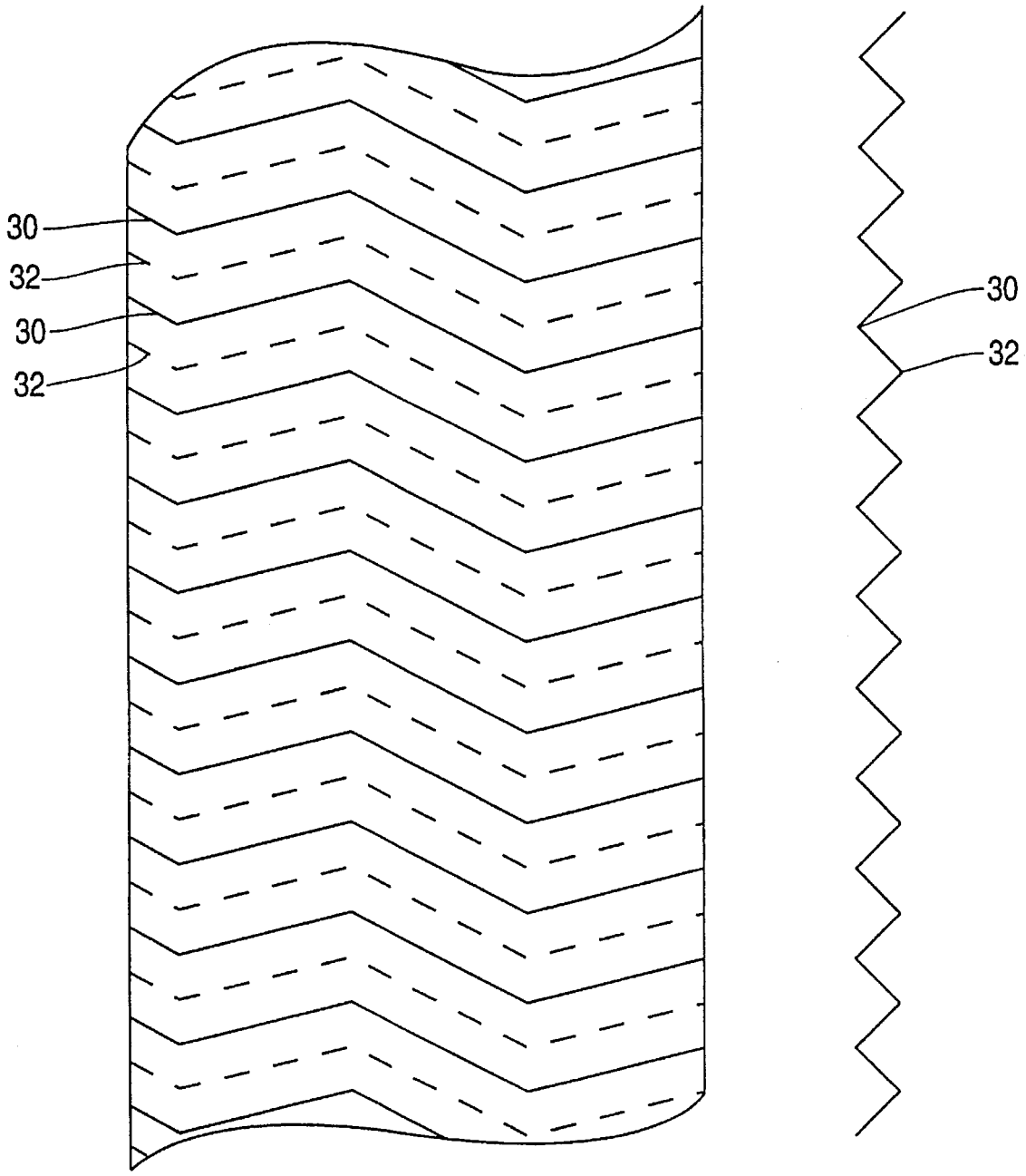
FIG. 3 (PRIOR ART)

FIG. 3 shows further detail of the metallic sheets having herringbone corrugation pattern which are suitably employed in the structure shown in FIG. 2 above or in structures of the invention when herringbone corrugations are used to induce tortuosity into the catalytic channels. As can be seen from the side and top or planar views represented in FIG. 3 the sheet is corrugated to form peaks (30) and valleys (32) which in turn form the herringbone pattern along the width of the sheet. The triangular corrugation pattern shown in FIGS. 2 and 3 is only for representation. The corrugation can be triangular, sinusoidal or any other corrugated structure envisioned in the art.

Figure 3A:
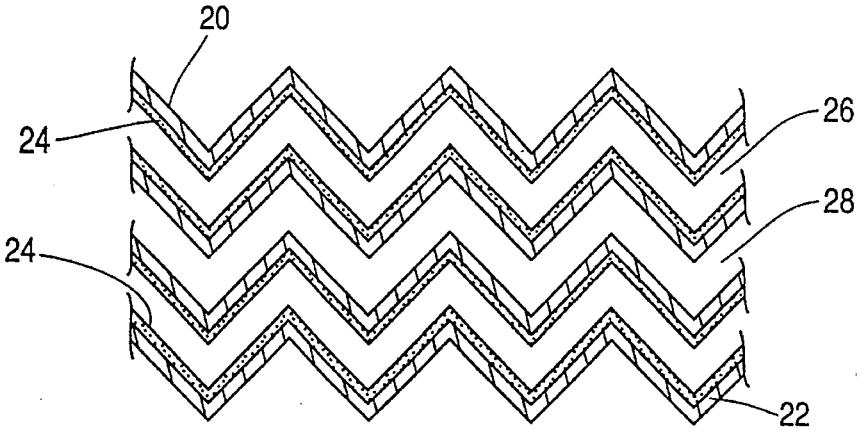
FIG. 3A (PRIOR ART)
Figure 3B:
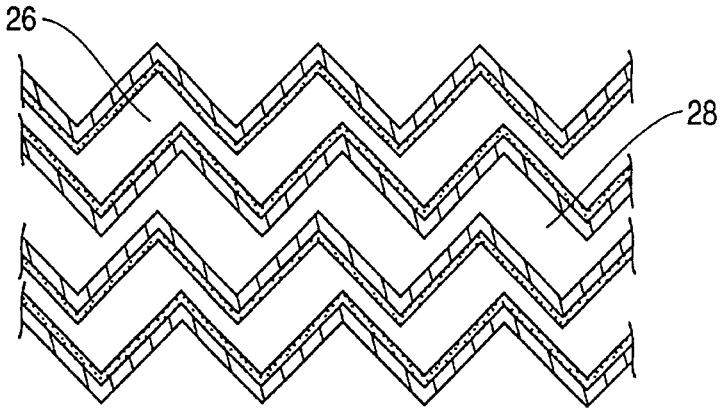
FIG. 3B (PRIOR ART)
Figure 3C:
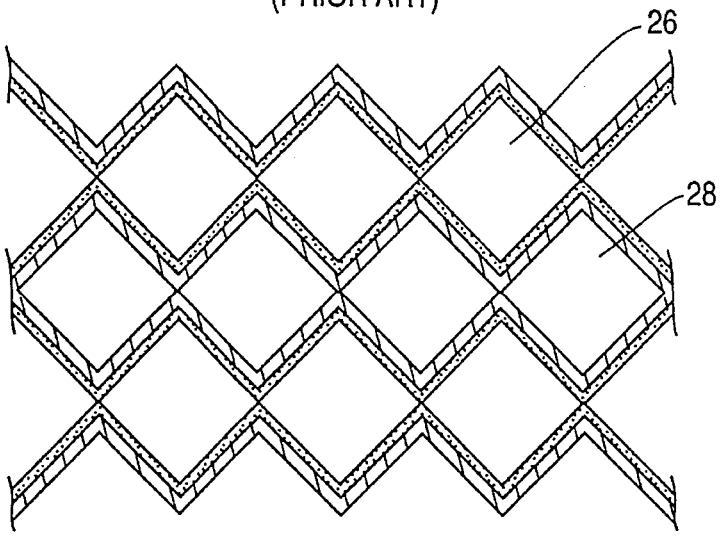
FIG. 3C (PRIOR ART)

The non-nesting nature of the corrugated sheets and the effect the herringbone corrugation pattern, shown in FIG. 2, has on the shape of the catalytic and non-catalytic channels at various points along their length is further illustrated in FIGS. 3A, 3B and 3C. These Figures show cross-sectional views of the repeating unit taken from the end view (FIG. 3A—which is the same as FIG. 2) and at incremental points on the longitudinal axis of the channels (FIGS. 3B and 3C) where the different directional orientations of the stacked herringbone corrugations cause the peaks and valleys formed by the corrugations in each sheet to change position relative to the position of the peaks and valleys of the corrugated sheet directly above and below it in the repeating unit. In FIG. 3A, the channels, both catalytic (26) and non-catalytic (28) have a repeating V-shaped cross-section wherein FIG. 3B the change in channel wall orientation caused by different directional orientations in the peaks and valleys of adjacent herringbone patterned corrugations results in channels (26 and 28) which are rectangular in cross-sectional area. Finally, in FIG. 3C, at the point where the peaks and valleys defining the herringbone corrugation pattern of a given sheet come into contact with the respective valleys and peaks of the herringbone patterned corrugations of sheets directly above and below the sheet in question, that is, the point where the herringbone corrugations on adjacent sheets cross-over one another, the catalytic channels (26) and non-catalytic channels (28) have a diamond shaped cross-sectional area. Of course, this pattern of changing cross-sectional shape of the channels will repeat itself over and over along the entire length of the channel defined by the non-nesting herringbone corrugations. In this case, even through the non-nesting herringbone patterned corrugations result in channels which have a variable cross-sectional area along their length, the catalytic and non-catalytic channels show identical variation along their length. As a result, the structure shown in FIG. 2 provides catalytic and non-catalytic channels wherein the average $D_h$ of the catalytic channels is equal to the average $D_h$ of the non-catalytic channels and where the h(cat)/h(non-cat) ratio is equal to 1.

Figure 4:
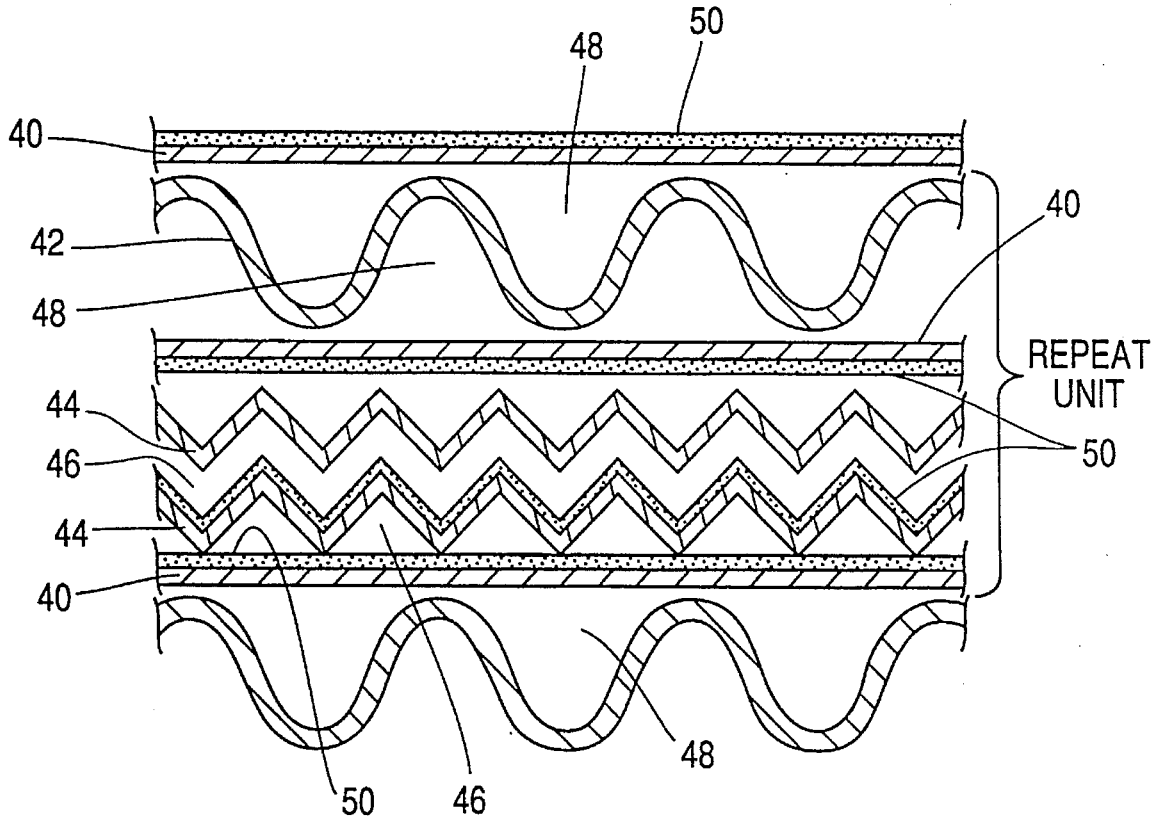
FIGS. 4, 5, 6, 7, and 8 show various configurations of the inventive catalyst structure.

FIG. 4 represents an end view of a repeating unit of a catalyst structure of the invention wherein a series of metallic sheets of various configurations are employed in a stacked pattern to afford catalytic channels which differ in configuration from the non-catalytic channels in accordance with the invention. This repeating unit is made up of a combination of two flat sheets (40), one corrugated sheet (42) a straight corrugation,pattern forming straight channels, and two corrugated sheets (44) having herringbone corrugation pattern. Catalytic channels (46) and non-catalytic channels (48) are formed by selectively coating one side of the two flat sheets and one side of one of the corrugated sheets with catalyst (50). As can be seen from the Figure, non-catalytic channels are formed from the stacking of the flat sheets with the straight channel sheet to provide large opened channels. In contrast, the catalytic channels are formed from herringbone corrugation foils or sheets stacked in non-nesting fashion between two flat sheets such that channels having tortuous flow paths and smaller $D_h$ are provided by the structure. This structure having the dimensions given in Example 2, below, provides catalytic and non-catalytic channels wherein the ratio of average $D_h$ of the catalytic channels to the average $D_h$ of the non-catalytic channels is 0.66 and the h(cat)/h(non-cat) ratio is 2.53. In that case, the ratio of heat transfer area between catalyst-coated and catalyst-free channels divided by the total channel volume in the structure is 0.30 $mm^{-1}$.

Figure 5:
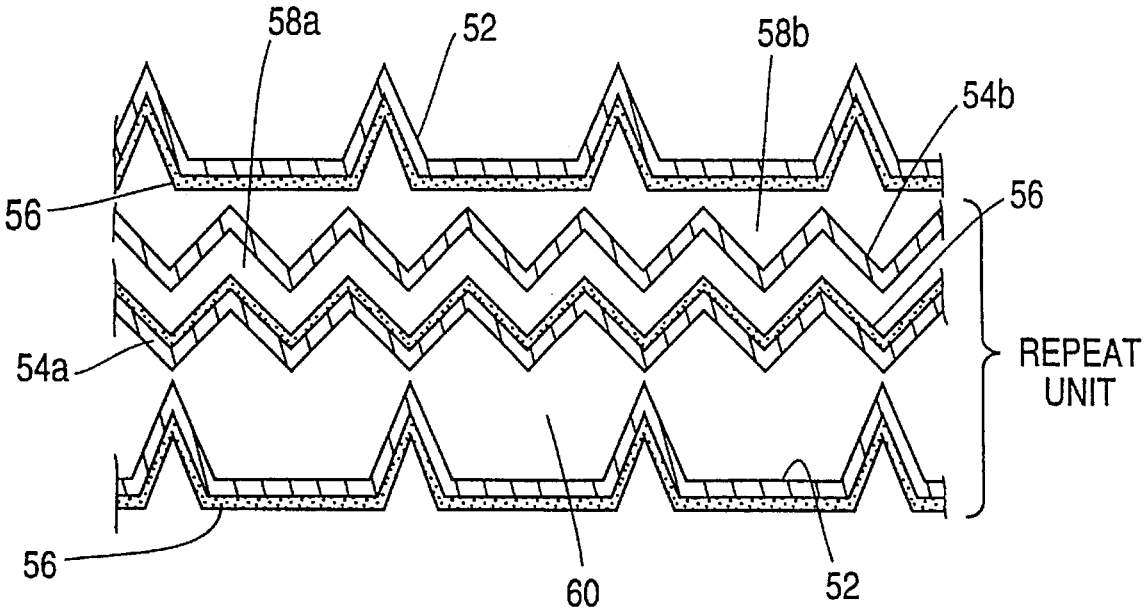

FIG. 5 depicts a preferred catalyst structure according to the invention by means of an end view of the repeating unit which is stacked to form the catalyst structure. This repeating unit is made up of three different types of corrugated metallic sheet (52, 54*a* and 54*b*). The first type of corrugated sheet (52) is essentially a flat sheet in which the extended flat regions are separated periodically by sharp peaked corrugations with the peaked corrugations extending straight across the foil forming a straight corrugation pattern. The second type of corrugated sheet (54*a* and 54*b*) is made up of a series of corrugations in the herringbone pattern. In the repeating unit shown, two of the herringbone corrugated sheets are stacked in non-nesting fashion on top of the sheet having wide regions of flat sheet separated by sharp peaked corrugations. In addition, a second flat sheet with sharp peaked corrugations is stacked on top of the top corrugated sheet in the non-nesting corrugated herringbone pattern stack. Catalyst (56) is coated on the bottom of each of the flat sheets with sharp peaked corrugations and on the top of the bottom corrugated herringbone pattern sheet thereby forming catalytic channels (58*a* and 58*b*) having small hydraulic diameters and tortuous flow channels and non-catalytic channel (60) which is a larger more open channel of substantially straight configuration. With this preferred catalyst structure constructed to have the dimensions given in Example 3, below, the ratio of the average $D_h$ of the catalytic channels to the average $D_h$ of the non-catalytic channels is 0.41 while the h(cat)/h(non-cat) ratio is 1.36. Further, the ratio of heat transfer area between catalytic and non-catalytic channels, divided by the total channel volume in this preferred structure having the dimensions given in Example 3, is 0.74.

The preferred structure depicted in FIG. 5 can be readily modified to increase the number and tortuosity of the catalytic channels by inserting additional corrugated sheets having a herringbone corrugation pattern between the two flat sheets with sharp peaked corrugations. If additional corrugated sheets are inserted in the repeat unit (stacked in non-nesting fashion with the two sheets shown in the Figure) they can be coated on one side of the other or remain uncoated depending on the catalyst structure desired.

Figure 6:
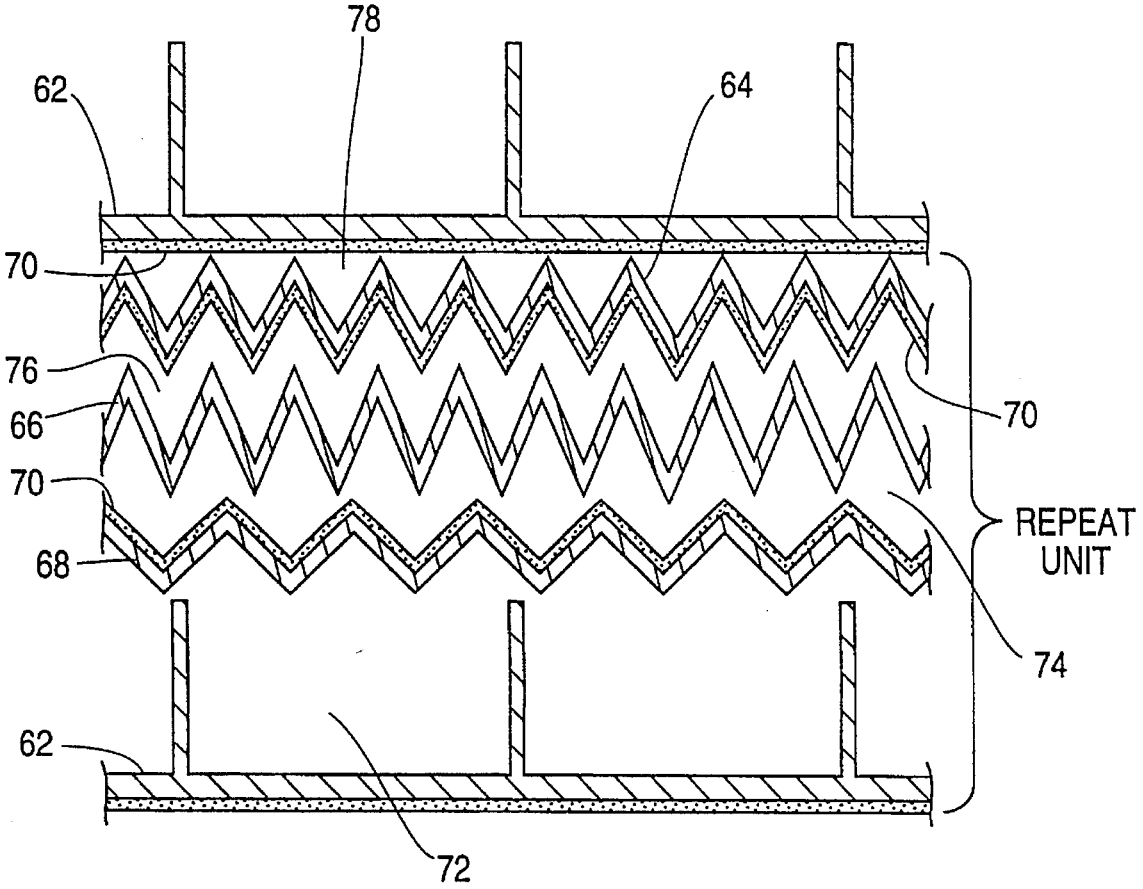

FIG. 6 illustrates the repeat unit of another catalyst structure of the invention viewed from its inlet end. As depicted, the support is made up of two essentially flat metallic sheets (62) wherein the horizontal flat regions are periodically divided by vertical strips to form large open regions and three corrugated metallic sheets having a herringbone corrugation pattern (64, 66 and 68) which are stacked in non-nesting fashion between the two essentially flat sheets. These three corrugated sheets differ in the severity of the corrugations, that is, the number of corrugations per unit of width, with the top and middle corrugated sheets (64 and 66) having a more severe corrugation pattern than the bottom corrugated sheet (68). The catalyst (70) is coated on the bottom of the two essentially flat sheets (62) and on the bottom of the top corrugated sheet (64) and top of the bottom corrugated sheet (68) with the result being as large open non-catalytic channel (72) which is essentially straight in configuration and three catalytic channels (74, 76 and 78) which have very small average $D_h$'s and configurations which create tortuous flow paths. For this structure in which sheet (62) has a height of 1.6 mm and a flat region of 3.3 mm; sheet (68) has a height of 0.41 mm and a peak-to-peak period of 0.66 mm; sheet (66) has a height of 1.1 mm and a peak-to-peak period of 0.33 mm; and sheet (64) has a height of 0.69 mm and a peak-to-peak period of 0.31 mm, the ratio of average $D_h$ of the catalytic channels to average $D_h$ of the non-catalytic channels is 0.15 and the h(cat)/h(non-cat) ratio is 2.72. In this case the ratio of heat transfer area between the catalyst-coated and catalyst-free channels divided by the total channel volume in the structure is 0.91 $mm^{-1}$.

Figure 7:
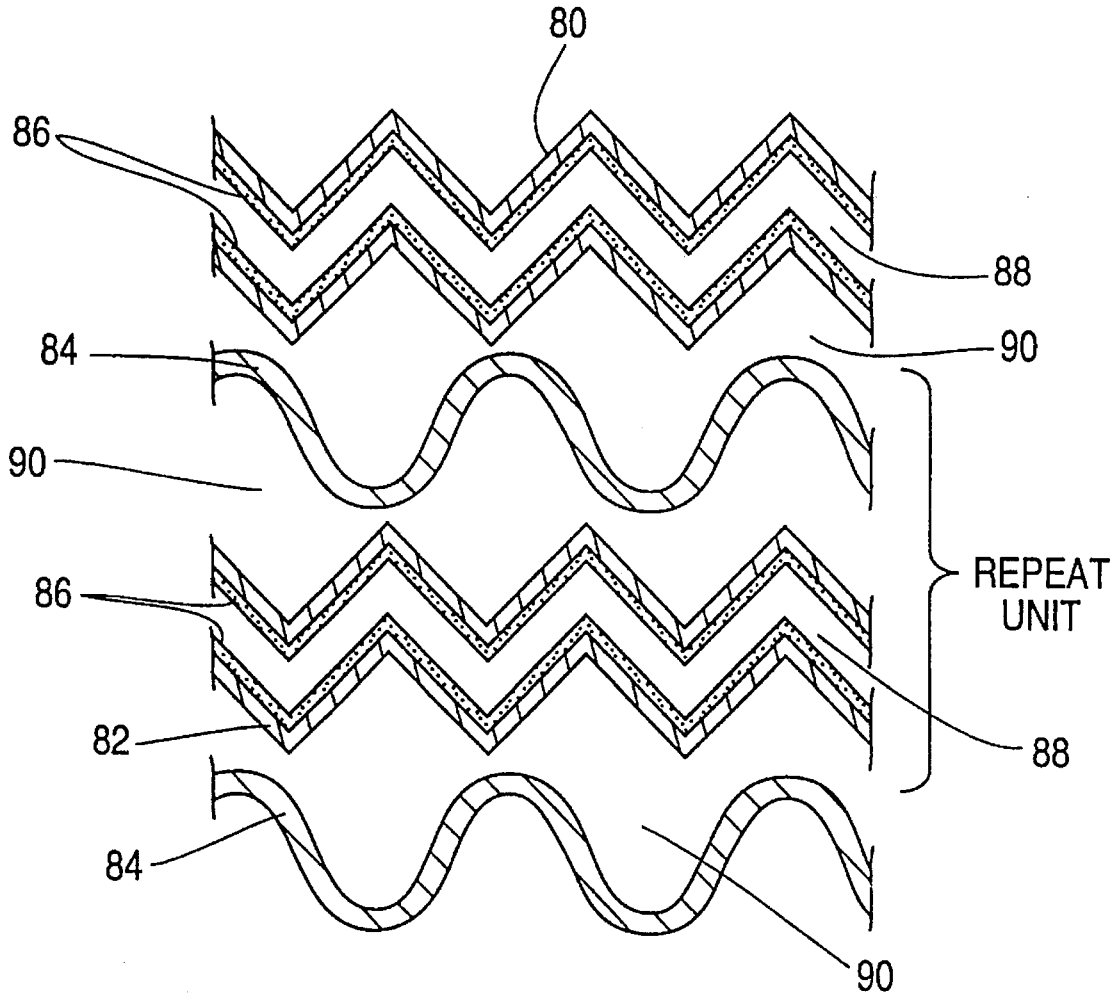
Figure 8:
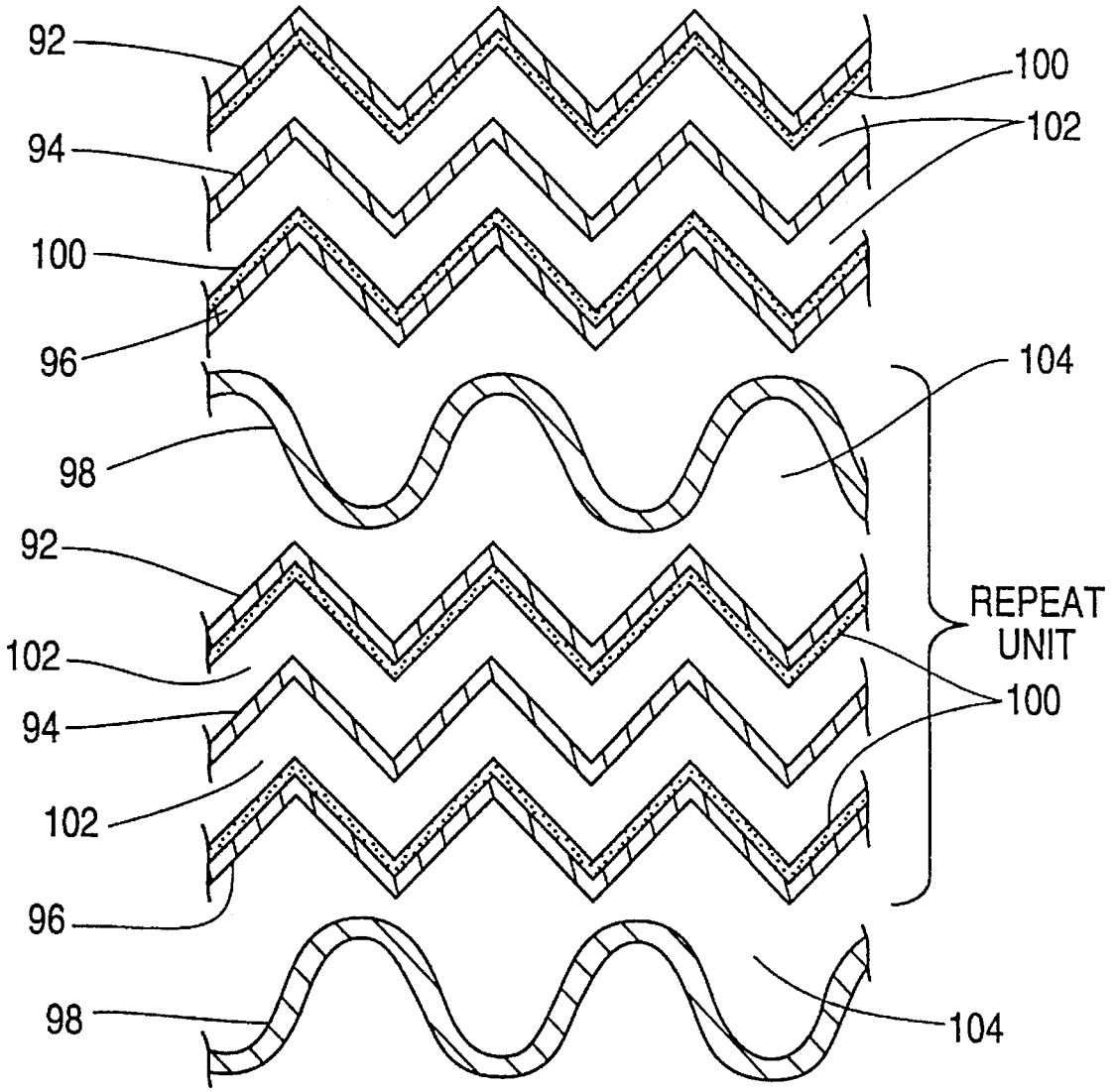

Based on the design criteria set forth above, one skilled in the art will be able to construct a variety of catalyst structures which are within the scope of the invention. Other possible structures are shown in FIGS. 7 and 8 where end views of repeat units for the structures are depicted. In FIG. 7, corrugated metal sheets (80 and 82) having a herringbone corrugation pattern are stacked in non-nesting fashion between a corrugated metal sheet (84) having crests and valleys extending in a longitudinal straight direction over the length of the sheet. Catalyst (86) is coated on the bottom of the top corrugated sheet (80) and the top of the bottom corrugated sheet (82) such that catalytic channels (88) of small average $D_h$ and significant tortuosity are formed in integral heat exchange with larger more open catalyst-free channels (90) which present essentially straight flow channels.

In FIG. 8, three corrugated metallic sheets (92, 94 and 96), having a herringbone corrugation pattern are stacked in non-nesting fashion between a straight channel corrugated metal sheet (98) of similar configuration to the corrugated sheet used in the structures of FIG. 7. Catalyst (100) is coated on the bottom of the top corrugated sheet (92) and the top of the bottom corrugated sheet (96) to form catalyst-coated channels (102) having a small average $D_h$ and tortuous flow paths in heat exchange relationship with larger, open catalyst-free channels (104) which have essentially straight flow paths.

EXAMPLES

The following examples demonstrate some of the advantages achieved by the use of the inventive catalyst structure as compared to conventional catalyst structures employing integral heat exchange.

Example 1

Using the conventional catalyst structure shown in FIG. 2, a catalyst was prepared and tested in the combustion of a gasoline-type fuel as follows:

A $SiO_2/ZrO_2$ powder was prepared by first mixing 20.8 g of tetraethylorthosilicate with 4.57 cc of 2 mM nitric acid and 12.7 g of ethanol. The mixture was added to 100 g of zirconia powder having a specific surface are of 100 $m^2$/gm. The resulting solid was aged in a sealed glass container for about a day and dried. One portion was calcined in air at 1000° C. and another portion was calcined in air at 1000° C.

A sol was prepared by mixing 152 g of the $SiO_2/ZrO_2$ powder calcined at 1000° C. and 15.2 g of the $SiO_2/ZrO_2$ powder calcined at 500° C. with 3.93 g of 98% $H_2SO_4$ and 310 cc of distilled water. This mixture was milled using $ZrO_2$ grinding media for eight hours to product a $SiO_2/ZrO_2$ sol.

A Fe/Cr/Al alloy (Fe/20%Cr/5%Al) foil strip 76 mm wide was corrugated in a herringbone pattern to a corrugation height of 1.20 mm and a peak to peak period of 2 mm and the herringbone pattern had channel lengths of 20 mm and a channel angle of 6° and forms a monolithic structure with about 185 cells per square inch. This foil was heat treated in air at 900° C. to form a rough oxide coated surface.

The $SiO_2/ZrO_2$ sol was sprayed onto one side of the herringbone corrugated foil to a thickness of about 40 micrometers and the coated foil calcined in air at 950° C. $Pd(NH_3)_2(NO_2)_2$ and $Pt(NH_3)_2(NO_2)_2$ was dissolved in water and an excess of nitric acid to form a solution containing about 0.1 g Pd/ml and a Pd/Pt ratio of 6; this solution was sprayed onto the $SiO_2/ZrO_2$ coated corrugated to form a final Pd loading of about 0.25 g Pd/g of $SiO_2/ZrO_2$ and calcined in air at 950° C.

A strip of the above foil was folded against itself to place the catalyzed side of the foil facing itself and the structure rolled to form a spiral monolithic structure of 50 mm diameter. This catalyst (rolled into a spiral wound structure with 50 mm diameter) was installed in the test rig described above. Thermocouples were installed to measure the substrate temperature and to measure temperatures of the gas downstream of the catalyst. In addition, a water-cooled gas sampling probe was installed in the reactor to measure the composition of the gas stream at the position 25 cm downstream of the catalyst. The test sequence was as follows:

1. Set air flow to that consistent with gas turbine idle condition.

2. Set air temperature at value in range of air temperature for gas turbine cycle at idle.

3. Increase fuel to flow necessary for adiabatic combustion temperature of 1200° C.

4. Increase air temperature to find upper limit of catalyst operation as determined by overheating of the catalyst. In this test procedure, the upper limit of catalyst operating temperature was taken at 1050° C. substrate temperature.

5. Similarly decrease the air temperature until the lower limit of catalyst operation is found as determined by an increase of emissions above the target value. In this test procedure, the lower limit was taken as the inlet air temperature when the CO emissions at 25 cm post-catalyst exceeded 5 ppm by volume (dry).

6. The procedures of steps 1 through 5 were repeated with the air flow typical of the gas turbine operated at full load conditions.

Specification Indolene Clear gasoline was used as the fuel. This is a standard unleaded regular gasoline used for emissions qualification. The fuel was injected into the main flow stream of heated air through a spray nozzle and vaporized prior to passing through the static mixer to form a uniform fuel/air mixture at the catalyst inlet. Fuel and air flow was continuously measured in real time and controlled through automatic feedback control.

The results of the test of the catalyst structure including test conditions employed are shown in Table 1 below.

TABLE 1

| Condition | Air Flow (SLPM) | Pressure (atm) | Tad(*C) | Inlet Temperature at Op Window Bottom (*C) | Inlet Temperature at Op Window Top (C*) |
|---|---|---|---|---|---|
| Idle | 291 | 1.3 | 1150 | 230 | 400 |
| | | | 1200 | 220 | 260 |
| | | | 1250 | 220 | 220 |
| Full Load | 2127 | 2.9 | 1200 | 540 | >620 |
| | | | 1300 | 420 | 570 |

Summary: At idle conditions, this catalyst will operate at a F/A ratio equivalent to an adiabatic combustion temperature of 1150° C. over an inlet temperature range of 230° to 400° C. At 1200° C. Tad, this inlet temperature range has narrowed to 220°–260° C. and at 1250° C. the catalyst will not operate without overheating.

At full load, this catalyst system operates reasonably well with an operating range of 540° to >620° C. at 1200° C. Tad, and 420° to 570° C. at 1300° C.

This catalyst system does not have a wide operating range at idle and cannot be used in a turbine that must operate from idle to full load, unless the fuel/air ratio is controlled to a very narrow range.

Example 2

To minimize combustion of fuel in the non-catalytic channels at low air flow rates, the catalyst structure shown in FIG. 4 was evaluated using the same fuel as employed in Example 1. The straight channel corrugation had a corrugation height of 1.65 mm and was approximately triangular with a peak-to-peak period of 3.90 mm. The herringbone corrugation foils were similar to that described in Example 1, except the foils had height of 0.76 mm and 0.91 mm and peak-to-peak period of 1.84 and 2.45 for the two foils. The catalytic coating (Pd-Pt/$SiO_2$/$ZrO_2$) was prepared and applied as described in Example 1. The performance of this catalyst structure using the same procedure described in Example 1 is shown in Table 2.

TABLE 2

| Condition | Air Flow (SLPM) | Pressure (atm) | Tad(°C.) | Inlet Temperature at Op Window Bottom (°C.) | Inlet Temperature at Op Window Top (°C.) |
|---|---|---|---|---|---|
| Idle | 291 | 1.3 | 1200 | 460 | >500 |
| | | | 1300 | 290 | 550 |
| Full Load | 2127 | 2.9 | 1200 | 610 | >620 |
| | | | 1300 | 510 | 610 |

Summary: This unit has substantially better performance at idle than the catalyst of Example 1. At these very low air flow rates, the catalyst substrate does not overheat so readily. However, the operating window at full load has decreased and the unit does not provide the inlet temperature operating range at 1200° and 1300° C. Tad required for optimum performance. Clearly, the use of open and large non-catalytic channels allows the catalyst to operate better at very low mass velocities but this particular design appears to have limited heat exchange between the catalytic channels and the non-catalytic channels. This results in a low outlet gas temperature from the catalyst at high mass flows and less than optimum performance at full load conditions.

Example 3

The catalyst structure of FIG. 5 was prepared and tested according to the procedures described in Example 1. In the catalyst structure tested, the herringbone corrugation foils were similar to that described in Example 1, except the foils had heights of 0.76 mm and 1.2 mm and pitches of 1.84 and 2.90 and a Chevron angle of 6° for the two herringbone foils and the straight corrugation peaked foil had a height of 1.63 mm, a peak-to-peak period of 4.52 mm and a flat region length of 3.7 mm. Again, the catalyst was Pd-Pt/$SiO_2$/$ZrO_2$ prepared in accordance with Example 1, and it was applied as shown in FIG. 5. The operating window conditions and test results are shown below using the Indolene Clear gasoline in Table 3.

TABLE 3

| Condition | Air Flow (SLPM) | Pressure (atm) | Tad(°C.) | Inlet Temperature at Op Window Bottom (°C.) | Inlet Temperature at Op Window Top (°C.) |
|---|---|---|---|---|---|
| Idle | 291 | 1.3 | 1200 | 390 | >500 |
| | | | 1300 | 280 | 490 |
| Full Load | 2127 | 2.9 | 1200 | 570 | >620 |
| | | | 1300 | 470 | 620 |

Summary: The catalyst structure has very wide operating windows at both idle and full load condition. At idle, this catalyst can operate over an inlet temperature range of 160° C. at 1200° C. Tad and over a range of 210° C. at 1300° C. Tad. At full load the range is >50° C. at 1200° C. These operating windows are sufficient Tad and is >50° C. at 1200° C. Tad and >150° C. at 1300° C. These operating windows are sufficient to make this catalyst system viable for use in a practical gas turbine. Comparison to the conventional technology of Example 1 shows that the catalyst of Example 3 can operate from 1200° to 1300° C. Tad range at both idle and full load while the conventional catalyst of Example 1 could only operate from 1150° C. to 1200° C. Tad and only over very narrow catalyst inlet temperatures at idle. In addition, the conventional technology of Example 1 would require very narrow control of fuel/air ratio which may be very difficult and costly. The technology of Example 3 has much broader operating windows and would permit more easy practical application. The operating range at full load was nearly as wide for the catalyst of Example 3 compared to Example 1.

This invention has been shown both by direct description and by example. The examples are not intended to limit the invention as later claimed in anyway; they are only examples. Additionally, one having ordinary skill in this art would be able to recognize equivalent ways to practice the invention described in these claims. Those equivalents are considered to be within the spirit of the claims invention.

What is claimed is:

1. A catalyst structure comprising a heat resistant support material composed of a plurality of common walls which form a multitude of adjacently disposed longitudinal channels for passage of a flowing gaseous reaction mixture wherein at least a part of the interior surface of at least a portion of the channels is coated with a catalyst and the interior surface of the remaining channels is not coated with catalyst such that the interior surface of the catalyst-coated channels are in heat exchange relationship with the interior surface of adjacent catalyst-free channels and wherein the catalyst-coated channels have a configuration which forms a more tortuous flow passage for the reaction mixture than the flow passage formed by the catalyst-free channels.

2. The catalyst structure of claim 1, wherein the catalyst-coated channels are periodically altered through a change in cross-sectional area, a change in direction along the longitudinal axis of the channels or a combination of both changes in cross-sectional area and direction along their longitudinal axis such that the flow direction of at least a portion of the gaseous reaction mixture in the catalyst-coated channels is changed at least a plurality of points as the gaseous reaction mixture passes through the catalyst-coated channels while the catalyst-free channels are substantially straight and of unaltered moss-sectional area along their longitudinal axis, such that the flow direction of gaseous reaction mixture through the catalyst-free channels is substantially unaltered.

3. The catalyst structure of claim 2, wherein the catalyst-coated channels are varied in cross-sectional area through a repeated inward and outward bending of the walls of the catalyst-coated channels along the longitudinal axis of the channels or through the use of flaps, baffles or other obstructions placed at a plurality of points along the longitudinal axis of the channels to partially obstruct the gaseous reaction mixture flow direction.

4. The catalyst structure of claim 3, wherein the catalyst-coated channels are varied in the cross-sectional area by the repeated inward and outward bending of the walls of the catalyst-coated channels which is accomplished with catalyst-coated channels which are corrugated in a herringbone pattern using corrugated sheets stacked in a non-nesting fashion.

5. The catalyst structure of claim 4, wherein the catalyst-coated channels and the catalyst-free channels are formed by a repeating three layer structure comprised of a first layer of corrugated sheet with longitudinal peaks separated by flat regions stacked upon a second layer composed of corrugated sheet in which the corrugations are formed as adjacent longitudinal ridges and valleys with these ridges and valleys forming a herringbone pattern along the length of the sheet making up the second layer, the second layer being stacked in non-nesting fashion upon a third layer composed of corrugated metallic sheet in which the corrugations are formed as adjacent longitudinal ridges and valleys with the ridges and valleys forming a herringbone pattern along the length of the sheet, making up the third layer and with catalyst for the reaction mixture being coated on the bottom side of the first layer and top side d the third layer such that catalyst-free channels are formed when the first layer of the repeating structure is set under the third layer of the next adjacent repeating three layer structure in a stacked pattern and catalyst-coated channels are formed between the bottom of the first layer and the top of the second layer and between the bottom of the second layer and the top of the third layer of the repeating three layer structure.

6. A catalyst structure comprising a heat resistant support material composed of a plurality of common walls which form a multitude of adjacently composed longitudinal channels for passage of a gaseous reaction mixture wherein at least a part of the interior surface of at least a portion of the channels is coated with a catalyst and the interior surface of the remaining channels is not coated with catalyst such that the interior surface of the catalyst-coated channels are in heat exchange relationship with the interior surface of adjacent catalyst-free channels and wherein:

(a) the catalyst-coated channels have a smaller average hydraulic diameter ($D_h$) than the catalyst-free channels;

(b) the catalyst-coated channels have a higher film heat transfer coefficient (h) than the catalyst-free channels; and (c) the catalyst-coated channels form a more tortuous flow passage for the reaction mixture than the flow passage formed by the catalyst-free channels.

7. The catalyst structure of claim 6, wherein the numeric ratio of the average $D_h$ for the catalyst-coated channels divided by the average $D_h$ of the catalyst-free channels is between about 0.15 and about 0.9.

8. The catalyst structure of claim 7, wherein the average $D_h$ of the catalyst-coated channels divided by the average $D_h$ of the catalyst-free channels is between about 0.3 and about 0.8.

9. The catalyst structure of claim 6, wherein the ratio of the film heat transfer coefficient (h) for the catalyst-coated channels divided by the film heat transfer coefficient (h) for the catalyst-free channels or h(cat)/h(non-cat) is between about 1.1 and about 7.

10. The catalyst structure of claim 9, wherein h(cat)/h(non-cat) is between about 1.3 and about 4.

11. The catalyst structure of claim 6, wherein the heat transfer surface area between the catalyst-coated channels and the catalyst-free channels divided by the total channel volume in the structure is more than about 0.5 $mm^{-1}$.

12. The catalyst structure of claim 11, wherein the heat transfer surface area between the catalyst-coated channels and the catalyst-free channels divided by the total channel volume is in the range of about 0.5 to about 2 $mm^{-1}$.

13. The catalyst structure of claim 12, wherein the heat transfer surface area between the catalyst-coated channels and catalyst-free channels divided by the total channel volume is in the range of about 0.5 to about 1.5 $mm^{-1}$.

14. The catalyst structure of claims 11, 12 or 13, wherein the h(cat)/h(non-cat) ratio is between about 1.1 and about 7 and the ratio of the average $D_h$ of the catalyst-coated channels divided by the average $D_h$ of the catalyst-free channels is between about 0.15 and about 0.9.

15. The catalyst structure of claims 11, 12 or 13 wherein the h(cat)/h(non-cat) is between about 1.3 and about 4 and the ratio of the average $D_h$ of the catalyst-coated channels divided by the average $D_h$ of the catalyst-free channels is between about 0.3 and about 0.8.

16. The catalyst structure of claims 1 or 6, wherein the size and number of catalyst-coated channels compared to the size and number of catalyst-free channels is such that between about 35% and 70% of the channel volume accessible to reaction mixture flow is in the catalyst-coated channels.

17. The catalyst structure of claim 16, wherein about 50% of the channel volume accessible to reaction mixture flow is in the catalyst-coated channels.

18. The catalyst structure of claim 14 wherein the size and number of catalyst-coated channels compared to the size and number of catalyst-free channels is such that between about 35% and 70% of the channel volume accessible to reaction mixture flow is in the catalyst-coated channels.

19. The catalyst structure of claim 15 wherein the size and number of catalyst-coated channels compared to the size and number of catalyst-free channels is such that between about 35% and 70% of the channel volume accessible to reaction mixture flow is in the catalyst-coated channels.

20. A catalyst structure comprising a heat resistant support material composed of a plurality of common walls which form a multitude of adjacently disposed longitudinal channels for passage of a gaseous reaction mixture wherein at least a part of the interior surface of at least a portion of the channels is coated with a catalyst and the interior surface of the remaining channels is not coated with catalyst such that the interior surface of the catalyst-coated channels are in heat exchange relationship with the interior surface of adjacent catalyst-free channels and wherein the catalyst-coated channels have a film heat transfer coefficient (h) which is more than 1.5 times greater than the h for catalyst-free channels and the catalyst-coated channels represent from about 20% to about 80% of the total open frontal area in the catalyst structure and the catalyst-coated channels form a more tortuous flow passage for the reaction mixture than the flow passage formed by the catalyst-free channels.

21. The catalyst structure of claim 20, wherein the ratio of h for the catalyst-coated channels divided by h for the catalyst-free channels is between about 1.5 and about 7.

22. A catalyst structure comprising a heat resistant support material composed of a plurality of common walls which form a multitude of adjacently disposed longitudinal channels for passage of a gaseous reaction mixture wherein at least a part of the interior surface of at least a portion of the channels it coated with a catalyst and the interior surface of the remaining channels is not coated with catalyst such that the interior surface of the catalyst-coated channels are in heat exchange relationship with the interior surface of adjacent catalyst-free channels and wherein the catalyst-coated channels have a lower average hydraulic diameter ($D_h$) than the catalyst-free channels and the numeric ratio of average $D_h$ for the catalyst-coated channels divided by the average $D_h$ for the catalyst-free channels is mailer than the numeric ratio of open frontal area of the catalyst-coated channels divided by the open frontal area of the catalyst-free channels.

23. The catalyst structure of claim 22, wherein the open frontal area of the catalyst-coated channels represents from about 20% to about 80% of the total open frontal area in the catalyst structure.

24. A catalyst structure comprising a heat resistant support material composed of a plurality of common walls which form a multitude of adjacently disposed longitudinal channels for passage of a reaction mixture wherein at least a part of the interior surface of at least a portion of the channels is coated with a catalyst and the interior surface of the remaining channels is not coated with catalyst such that the interior surface of the catalyst-coated channels are in heat exchange relationship with the interior surface of adjacent catalyst-free channels and wherein:

(a) the catalyst-coated channels have a higher film heat transfer coefficient (h) than the catalyst-free channels;

(b) the catalyst-coated channels have a smaller average hydraulic diameter ($D_h$) than the catalyst-free channels; and (c) the numeric ratio of the average $D_h$ for the catalyst-coated channels divided by the average $D_h$ for the catalyst-free channels is smaller than the numeric ratio of the open frontal area of the catalyst-coated channels divided by the open frontal area of the catalyst-free channels.

25. The catalyst structure of claim 24, wherein the numeric ratio of the average $D_h$ for the catalyst-coated channels divided by the average $D_h$ of the catalyst-free channels is between about 0.15 and about 0.9.

26. The catalyst structure of claim 25, wherein the average $D_h$ of the catalyst-coated channels divided by the average $D_h$ of the catalyst-free channels is between about 0.3 and about 0.8.

27. The catalyst structure of claim 24, wherein the ratio of the film heat transfer coefficient (h) for the catalyst-coated channels divided by the film heat transfer coefficient (h) for the catalyst-free channels or h(cat)/h(non-cat) is between about 1.1 and about 7.

28. The catalyst structure of claim 27, wherein h(caat)/h(non-cat) is between about 1.3 and about 4.

29. The catalyst structure of claim 24, wherein the heat transfer surface area between the catalyst-coated channels and the catalyst-free channels divided by the total channel volume in the structure is more than about 0.5 $mm^{-1}$.

30. The catalyst structure of claim 29, wherein the heat transfer surface area between the catalyst-coated channels and the catalyst-free channels divided by the total channel volume is in the range of about 0.5 to about 2 $mm^{-1}$.

31. The catalyst structure of claim 30, wherein the heat transfer surface area between the catalyst-coated channels and catalyst-free channels divided by the total channel volume is in the range of about 0.5 to about 1.5 $mm^{-1}$.

32. The catalyst structure of claims 29, 30 or 31, wherein the h(cat)/h(non-cat) ratio is between about 1.1 and about 7 and the ratio of the average $D_h$ of the catalyst-coated channels divided by the average $D_h$ of the catalyst-free channels is between about 0.15 and about 0.9.

33. The catalyst structure of claims 29, 30 or 31 wherein the h(cat)Pa(non-cat) is between about 1.3 and about 4 and the ratio of the average $D_h$ of the catalyst-coated channels divided by the average $D_h$ of the catalyst-free channels is between about 0.3 and about 0.8.

34. The catalyst structure of claims 24 or 29, wherein the size and number of catalyst-coated channels compared to the size and number of catalyst-free channels is such that between about 35% and 70% of the channel volume accessible to reaction mixture flow is in the catalyst-coated channels.

35. The catalyst structure of claim 34, wherein about 50% of the channel volume accessible to reaction mixture flow is in the catalyst-coated channels.

36. A catalyst structure comprising a heat resistant support material composed of a plurality of common walls which form a multitude of adjacently disposed longitudinal channels for passage of a gaseous reaction mixture wherein at least a part of the interior surface of at least a portion of the channels is coated with a catalyst and the interior surface of the remaining channels is not coated with catalyst such that the interior surface of the catalyst-coated channels are in heat exchange relationship with the interior surface of adjacent catalyst-free channels and wherein:

(a) the catalyst-coated channels have a higher film heat transfer coefficient (h) than the catalyst-free channels;

(b) more than 50% of the total reaction mixture flow is through the catalyst-coated channels; and (c) the catalyst-coated channels form a more tortuous flow passage for the reaction mixture than the flow passage formed by the catalyst-free channels.

37. A catalyst structure comprising a heat resistant support material composed of a plurality of common walls which form a multitude of adjacently disposed longitudinal channels for passage of a gaseous reaction mixture wherein at least a part of the interior surface of at least a portion of the channels is coated with a catalyst and the interior surface of the remaining channels is not coated with catalyst such that the interior surface of the catalyst-coated channels are in heat exchange relationship with the interior surface of adjacent catalyst-free channels and wherein;

(a) the catalyst-coated channels have a higher film heat transfer coefficient (h) than the catalyst-free channels by a factor greater than 1.2; and (b) more than 40%, but less than 50% of the total reaction mixture flow is through the catalyst-coated channels; and (c) the catalyst-coated channels form a more tortuous flow passage for the reaction mixture than the flow passage formed by the catalyst-free channels.

38. A catalyst structure comprising a heat resistant support material composed of a plurality of common walls which form a multitude of adjacently disposed longitudinal channels for passage of a gaseous reaction mixture wherein at least a part of the interior surface of at least a portion of the channels is coated with a catalyst and the interior surface of the remaining channels is not coated with catalyst such that the interior surface of the catalyst-coated channels are in heat exchange relationship with the interior surface of adjacent catalyst-free channels and-wherein:

(a) the catalyst-coated channels have a higher film heat transfer coefficient (h) than the catalyst-free channels by a factor greater than 1.3; and (b) more than 30%, but less than 40% of the total reaction mixture flow is through the catalyst-coated channels; and (c) The catalyst-coated channels form a more tortuous flow passage for the reaction mixture than the flow passage formed by the catalyst-free channels.

39. A catalyst structure comprising a heat resistant support material composed of a plurality of common walls which form a multitude of adjacently disposed longituainal channels for passage of a gaseous reaction mixture wherein at least a part of the interior surface of at least a portion of the channels is coated with a catalyst and the interior surface of the remaining channels is not coated with catalyst such that the interior surface of the catalyst-coated channels are in heat exchange relationship with the interior surface of adjacent catalyst-free channels and wherein:

(a) the catalyst-coated channels have a higher film heat transfer coefficient (h) than the catalyst-free channels by a factor greater than 1.5; and (b) more than 20%, but less than 30% of the total reaction mixture flow is through the catalyst-coated channels; and (c) the catalyst-coated channels form a more tortuous flow passage for the reaction mixture than the flow passage formed by the catalyst-free channels.

40. A catalyst structure comprising a heat resistant support material composed of a plurality of common walls which form a multitude of adjacently disposed longitudinal channels for passage of a gaseous reaction mixture wherein at least a part of the interior surface of at least a portion of the channels is coated with a catalyst and the interior surface of the remaining channels is not coated with catalyst such that the interior surface of the catalyst-coated channels are in heat exchange relationship with the interior surface of adjacent catalyst-free channels and wherein:

(a) the catalyst-coated channels have a higher film heat transfer coefficient (h) than the catalyst-free channels by a factor greater than 2.0; and (b) more than 10%, but less than 20% of the total reaction mixture flow is through the catalyst-coated channels; and (c) the catalyst-coated channels form a more tortuous flow passage for the reaction mixture than the flow passage formed by the catalyst-free channels.

41. The catalyst structure of claims 36, 37, 38, 39 or 40, wherein the catalyst-coated channels have a smaller average hydraulic diameter ($D_h$) than the catalyst-free channels.

42. A catalyst structure comprising a heat resistant support material composed of a plurality of common walls which form a multitude of adjacently disposed longitudinal channels for passage of a combustible mixture wherein at least a part of the interior surface of at least a portion of the channels is coated with a catalyst suitable for oxidizing the combustible mixture and the, interior surface of the remaining channels are not coated with catalyst such that the interior surface of the catalyst-coated channels are in heat exchange relationship with the interior surface of adjacent catalyst-free channels and wherein:

(a) the catalyst-coated channels have a higher film heat transfer coefficient (h) than the catalyst-free channels;

(b) the catalyst-coated channels have a smaller average hydraulic diameter ($D_h$) than the catalyst-free channels; and (c) the catalyst-coated channels form a more tortuous flow passage for the combustible mixture than the flow passage formed by the catalyst-free channels.

43. A catalyst structure comprising a heat resistant support material composed of a plurality of common walls which form a multitude of adjacently disposed longitudinal channels for passage of a combustible mixture wherein at least a part of the interior surface of at least a portion of the channels is coated with a catalyst suitable for oxidizing the combustible mixture and the interior surfaced of the remaining channels are not coated with catalyst such that the interior surface of the catalyst-coated channels are in heat exchange relationship with the interior surface of adjacent catalyst-free channels and wherein:

(a) the catalyst-coated channels have a higher film heat transfer coefficient (h) than the catalyst-free channels;

(b) the catalyst-coated channels have a smaller average hydraulic diameter ($D_h$) than the catalyst-free channels; and (c) the numeric ratio of the average $D_h$ for the catalyst-coated channels divided by the average $D_h$ for the catalyst-free channels is smaller than the numeric ratio of the open frontal area of the catalyst-coated channels divided by the open frontal area of the catalyst-free channels.

44. The catalyst structure of claims 42 or 43, wherein between about 35% and 70% of the total combustible mixture flow is through the catalyst-coated channels.

45. The catalyst structure of claims 42 or 43, wherein about 50% of the total combustible mixture flow is through the catalyst-coated channels.

46. The catalyst structure of claims 42 or 43, wherein the heat transfer surface area between the catalyst-coated channels and the catalyst-free channels divided by the total channel volume is greater than about 0.5 $mm^{-1}$.

47. The catalyst structure of claim 46, wherein the ratio of the average $D_h$ of the catalyst-coated channels divided by the average $D_h$ of the catalyst-free channels is between about 0.15 and about 0.9.

48. The catalyst structure of claim 47, wherein the ratio of the average $D_h$ of the catalyst-coated channels divided by the average $D_h$ of the catalyst-free is between about 0.3 and about 0.8.

49. The catalyst structure of claim 47, wherein the ratio of the h for the catalyst-coated channels divided by the h for the catalyst-free channels is between about 1.1 and about 7.

50. The catalyst structure of claim 48, wherein the ratio of the h for the catalyst-coated channels divided by the h for the catalyst-free channels is between about 1.3 and about 4.

51. The catalyst structure of claim 44, wherein the support material is selected from ceramic materials, heat resistant inorganic oxides, intermetallic materials, carbides, nitrides and metallic materials.

52. The catalyst structure of claim 51, wherein the inorganic oxide is selected from silica, magnesia, alumina, titania, zirconia and mixtures thereof and the metallic material is selected from aluminum, a high temperature metal alloy, stainless steel and an aluminum-containing steel and an aluminum-containing alloy.

53. The catalyst structure of claim 51, wherein the catalyst is one or more platinum group elements.

54. The catalyst structure of claim 53, wherein the catalyst comprises palladium or mixtures of palladium and platinum.

55. The catalyst structure of claim 53, wherein the support material additionally comprises a washcoat of zirconia, titania, alumina, silica or other refractory metal oxide on at least a portion of the support.

56. The catalyst structure of claim 55, wherein the washcoat comprises alumina, silica or mixtures of alumina and silica.

57. The catalyst structure of claim 55, wherein the washcoat comprises zirconia.

58. The catalyst structure of claim 55, wherein the catalyst is palladium or mixtures of palladium and platinum on the washcoat.

59. A process for the combustion of a combustible mixture comprising the steps of:

(a) mixing a fuel and an oxygen-containing gas to form a combustible mixture;

(b) contacting the mixture with a heat resistant catalyst support composed of a plurality of common walls which form a multitude of adjacently disposed longitudinal channels for passage of the combustible mixture wherein at least a part of the interior surface of at least a portion of the channels is coated with a catalyst for the combustible mixture and the interior surface of the remaining channels is not coated with catalyst such that the interior surface of the catalyst-coated channels are in heat exchange relationship with the interior surface of adjacent catalyst-free channels and wherein:

(i) the catalyst-coated channels have a higher film heat transfer coefficient (h) than the catalyst-free channels;

(ii) the catalyst-coated channels have a smaller average $D_h$ than the catalyst-free channels; and (iii) the catalyst-coated channels form a more tortuous flow passage for the combustible mixture than the flow passage formed by the catalyst-free channels.

60. A process for the combustion of a combustible mixture comprising the steps of:

(a) mixing a fuel and an oxygen-containing gas to form a combustible mixture;

b) contacting the mixture with a heat resistant catalyst support composed of a plurality of common walls which form a multitude of adjacently disposed longitudinal channels for passage of the combustible mixture wherein at least a part of the interior surface of at least a portion of the channels is coated with a catalyst for the combustible mixture and the interior surface of the remaining channels is not coated with catalyst such that the interior surface of the catalyst-coated channels are in heat exchange relationship with the interior surface of adjacent catalyst-free channels and wherein;

(i) the catalyst-coated channels have a higher film heat transfer coefficient (h) than the catalyst-free channels;

(ii) the catalyst-coated channels have a smaller average $D_h$ than the catalyst-free channels; and (iii) the numeric ratio of average $D_h$ for the catalyst-coated channels divided by the average $D_h$ for the catalyst-free channels is smaller than the numeric ratio of open frontal area of the catalyst-coated channels divided by the open frontal area of the catalyst-free channels.

61. The process of claims 59 or 60, wherein the heat transfer surface area between the catalyst-coated channels and the catalyst-free channels divided by the total channel volume in the structure is greater than about 0.5 $mm^{-1}$.

62. The process of claim 61, wherein the distribution of combustible mixture flow through the catalyst support is such that between about 35% and about 70% of the combustible mixture passes through the catalyst-coated channels.

63. The process of claim 62, wherein about 50% of the combustible mixture passes through the catalyst-coated channels.

64. The process of claims 59 or 60, wherein the catalyst support comprises a ceramic material, a heat resistant inorganic oxide, a intermetallic material, a carbide, a nitride or a metallic material.

65. The process of claim 64, wherein the catalyst support comprises a metallic material selected from the class consisting of aluminum, a high temperature alloy, stainless steel, an alloy containing aluminum and a ferrous alloy containing aluminum.

66. The process of claim 65, wherein the catalyst support comprises a ferrous or non-ferrous alloy containing aluminum.

67. The process of claim 66, wherein the catalyst support additionally comprises a washcoat of zirconia, titania, alumina, silica, or a refractory metal oxide on at least a portion of the support.

68. The process of claim 67, wherein the metallic catalyst support additionally comprises a washcoat of zirconia on at least a portion of the support.

69. The process of claim 68, wherein the catalytic material is one or more platinum group elements.

70. The process of claim 69, wherein the catalytic material comprises palladium.

71. The process of claim 70, wherein the combustible mixture has a theoretical adiabatic combustion temperature above 900° C.

72. The process of claims 59 or 60, wherein the combustible mixture is partially combusted on contact with the catalyst structure and the combustion is completed in a homogeneous combustion zone after the combustible mixture is passed through the catalyst structure.

73. The process of claim 61 wherein the catalyst support comprises a ceramic material, a heat resistant inorganic oxide, an intermetallic material, a carbide, a nitride or a metallic material.

74. The process of claim 62 wherein the catalyst support comprises a ceramic material, a heat resistant inorganic oxide, an intermetallic material, a carbide, a nitride or a metallic material.

* * * * *